US010603907B2

(12) United States Patent
Takagi

(10) Patent No.: US 10,603,907 B2
(45) Date of Patent: Mar. 31, 2020

(54) LIQUID EJECTING APPARATUS

(71) Applicant: SEIKO EPSON CORPORATION, Tokyo (JP)

(72) Inventor: Tetsuo Takagi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/355,970

(22) Filed: Mar. 18, 2019

(65) Prior Publication Data

US 2019/0291422 A1 Sep. 26, 2019

(30) Foreign Application Priority Data

Mar. 20, 2018 (JP) ..... 2018-052190
Jul. 26, 2018 (JP) ..... 2018-140426

(51) Int. Cl.
*B41J 2/045* (2006.01)
*B41J 2/14* (2006.01)

(52) U.S. Cl.
CPC ..... *B41J 2/04581* (2013.01); *B41J 2/0455* (2013.01); *B41J 2/04541* (2013.01); *B41J 2/04548* (2013.01); *B41J 2/04551* (2013.01); *B41J 2/04555* (2013.01); *B41J 2/04588* (2013.01); *B41J 2/04593* (2013.01); *B41J 2/04596* (2013.01); *B41J 2/14201* (2013.01); *B41J 2/14233* (2013.01); *B41J 2002/14241* (2013.01); *B41J 2002/14362* (2013.01); *B41J 2002/14419* (2013.01)

(58) Field of Classification Search
CPC ..... B41J 2/04581; B41J 2/04541; B41J 2/04548; B41J 2/0455; B41J 2/04551; B41J 2/04555; B41J 2/04588; B41J 2/04593; B41J 2/04596; B41J 2/14201; B41J 2/14233; B41J 2/14209; B41J 2/14274
See application file for complete search history.

(56) References Cited

U.S. PATENT DOCUMENTS 6,504,701 B1 * 1/2003 Takamura et al. ..... B41J 2/0452
2013/0229678 A1 9/2013 Ishikawa et al.
2015/0069934 A1 * 3/2015 Gardner ..... B41J 2/04548
2017/0057221 A1 3/2017 Nozawa

FOREIGN PATENT DOCUMENTS

JP 2013-180480 A 9/2013
JP 2017-043007 A 3/2017

* cited by examiner

*Primary Examiner* — Juanita D Jackson
(74) *Attorney, Agent, or Firm* — Global IP Counselors, LLP

(57) ABSTRACT

A liquid ejecting apparatus includes a piezoelectric element that includes a first electrode to which a drive signal is supplied and a second electrode to which a criterion voltage signal is supplied, and performs displacement by a potential difference between the first electrode and the second electrode, a cavity which is filled with a liquid, a vibration plate provided between the cavity and the piezoelectric element, and a first switching circuit that includes a first terminal to which the drive signal is supplied and a second terminal which is electrically connected to the first electrode and controls a supply of the drive signal to the first electrode. The liquid ejecting apparatus has a first mode in which charges at a first node at which the first electrode and the second terminal are electrically connected to each other are released via a parasitic diode of the first switching circuit.

12 Claims, 21 Drawing Sheets

FIG. 10

| OPERATION MODE | | PRINTING MODE | | | | STANDBY MODE | TRANSFER MODE | SLEEP MODE |
|---|---|---|---|---|---|---|---|---|
| | | LARGE DOT | MEDIUM DOT | SMALL DOT | FINE VIBRATION | | | |
| [SIH, SIL] | | [1, 1] | [1, 0] | [0, 1] | [0, 0] | – | – | – |
| [MCH, MCL] | | [1, 1] | | | | [1, 0] | [0, 0] | [0, 1] |
| S | T1 | H | H | L | L | H | L | L |
| | T2 | H | L | H | L | | | |
| | T3 | L | L | L | H | | | |

LIQUID EJECTING APPARATUS

The entire disclosure of Japanese Patent Application No. 2018-052190, filed Mar. 20, 2018 and 2018-140426, filed Jul. 26, 2018 are expressly incorporated by reference herein.

BACKGROUND

1. Technical Field

The present invention relates to a liquid ejecting apparatus.

2. Related Art

It is known that, for example, a piezoelectric element is used in an ink jet printer (liquid ejecting apparatus) that performs printing of an image or a document by ejecting a liquid such as an ink. The piezoelectric element is provided to correspond to a plurality of nozzles of ejecting an ink and a cavity that stores the ink to be ejected from the nozzle in a print head. If the piezoelectric element performs displacement in accordance with a drive signal, a vibration plate provided between the piezoelectric element and the cavity bends, and thus the volume of the cavity changes. Accordingly, a predetermined amount of ink is ejected from the nozzles at a predetermined timing, and thereby a dot is formed on a medium.

JP-A-2017-43007 discloses a liquid ejecting apparatus as follows. The liquid ejecting apparatus ejects an ink by controlling displacement of a piezoelectric element that performs displacement based on a potential difference between an upper electrode and a lower electrode, in a manner that a drive signal generated based on print data is supplied to the upper electrode, a criterion voltage is supplied to the lower electrode, and whether or not the drive signal is supplied is controlled by a selection circuit (switching circuit).

In the liquid ejecting apparatus that ejects an ink based on the displacement of the piezoelectric element as disclosed in JP-A-2017-43007, in a case where a not-intended DC voltage is supplied to the piezoelectric element, the piezoelectric element may continuously perform displacement without an intention. In a case where the piezoelectric element performs not-intended displacement, a vibration plate also performs displacement based on the not-intended displacement of the piezoelectric element. As a result, the vibration plate bends larger than expected, and thus not-intended stress is applied to the vibration plate.

In a case where the not-intended stress as described above is applied to the vibration plate for a long term, the stress may concentrate on a contact point between the vibration plate and the cavity as a center, and thus cracks may occur in the vibration plate.

Further, in a case where the vibration plate transitions from a state where the vibration plate bends without an intention to an ejection operation, a larger load than necessary may be applied to the vibration plate, and cracks may occur in the vibration plate by the load.

If a crack occurs in the vibration plate, an ink stored in the cavity is leaked from the crack, and thus the amount of the ejected ink varies depending on a change of the volume of the cavity. As a result, ejection accuracy of the ink is deteriorated.

Further, in a case where the ink leaked from the cracks adheres to both the upper electrode and the lower electrode of the piezoelectric element, a current path via the ink is formed between the upper electrode and the lower electrode. As a result, the potential of the criterion voltage signal to be supplied to the lower electrode fluctuates. In a case where the criterion voltage signal is commonly supplied to a plurality of piezoelectric elements, the fluctuation of the potential of the criterion voltage signal influences the displacement of the plurality of piezoelectric elements. That is, the fluctuation of the potential thereof may influence not only ejection accuracy from the nozzle corresponding to the vibration plate in which cracks have occurred, but also ejection accuracy of an ink in the entirety of the liquid ejecting apparatus.

A problem of displacement of the piezoelectric element and the vibration plate occurring by continuously applying a not-intended voltage to the piezoelectric element for a long term, as described above, is a new problem which has not been disclosed in JP-A-2017-43007.

SUMMARY

According to an aspect of the invention, a liquid ejecting apparatus includes a piezoelectric element that includes a first electrode to which a drive signal is supplied and a second electrode to which a criterion voltage signal is supplied, and that performs displacement by a potential difference between the first electrode and the second electrode, a cavity which is filled with a liquid being ejected from a nozzle by the displacement of the piezoelectric element, a vibration plate provided between the cavity and the piezoelectric element, and a first switching circuit that includes a first terminal to which the drive signal is supplied and a second terminal which is electrically connected to the first electrode, and that controls a supply of the drive signal to the first electrode. The liquid ejecting apparatus has a first mode in which charges at a first node at which the first electrode and the second terminal are electrically connected to each other are released via a parasitic diode of the first switching circuit.

In the liquid ejecting apparatus, the first switching circuit may include an NMOS transistor and a PMOS transistor. The first terminal may be electrically connected to a drain terminal of the NMOS transistor and a source terminal of the PMOS transistor. The second terminal may be electrically connected to a source terminal of the NMOS transistor and a drain terminal of the PMOS transistor. In the first mode, a back gate terminal of the NMOS transistor and a back gate terminal of the PMOS transistor may be electrically connected to a ground terminal.

In the liquid ejecting apparatus, the first mode may be performed in a case where the first switching circuit is in an OFF state.

The liquid ejecting apparatus may further include a criterion-voltage signal generation circuit that outputs the criterion voltage signal from a third terminal, and a second switching circuit which is provided to be capable of switching an electrical connection between the third terminal and a ground terminal. The liquid ejecting apparatus may have a second mode in which charges at a second node at which the second electrode and the third terminal are electrically connected to each other are released via the second switching circuit.

In the liquid ejecting apparatus, the first mode may be performed after the second mode.

In the liquid ejecting apparatus, the second mode may be performed in a case where the first switching circuit is in an OFF state.

The liquid ejecting apparatus may further include a drive circuit that outputs the drive signal from a fourth terminal, and a third switching circuit which is provided to be capable of switching an electrical connection between the fourth terminal and a ground terminal. The liquid ejecting apparatus may have a third mode in which charges at a third node at which the first terminal and the fourth terminal are connected to each other are released via the third switching circuit.

In the liquid ejecting apparatus, the first mode may be performed after the third mode.

In the liquid ejecting apparatus, the third mode may be performed in a case where the first switching circuit is in an OFF state.

According to another aspect of the invention, a liquid ejecting apparatus includes a piezoelectric element that includes a first electrode to which a drive signal is supplied and a second electrode to which a criterion voltage signal is supplied, and that performs displacement by a potential difference between the first electrode and the second electrode, a cavity which is filled with a liquid being ejected from a nozzle by the displacement of the piezoelectric element, a vibration plate which is provided between the cavity and the piezoelectric element, and a first switching circuit that includes a first terminal to which the drive signal is supplied and a second terminal which is electrically connected to the first electrode, and that controls a supply of the drive signal to the first electrode. The first switching circuit includes a PMOS transistor. The first terminal is electrically connected to a source terminal of the PMOS transistor. The second terminal is electrically connected to a drain terminal of the PMOS transistor. A back gate terminal of the PMOS transistor is electrically connected to one end of a switch element. Another end of the switch element is electrically connected to a ground terminal.

In the liquid ejecting apparatus, the source terminal may be electrically connected to a first P-type semiconductor layer provided in an N-type semiconductor layer. The drain terminal may be electrically connected to a second P-type semiconductor layer provided in the N-type semiconductor layer so as to be spaced from the first P-type semiconductor layer. The back gate terminal may be electrically connected to the N-type semiconductor layer.

In the liquid ejecting apparatus, the switch element may be provided in a fourth switching circuit. The fourth switching circuit may control whether to supply a voltage to the back gate terminal or whether to electrically connect the back gate terminal and the ground terminal to each other.

BRIEF DESCRIPTION OF THE DRAWINGS

The invention will be described with reference to the accompanying drawings, wherein like numbers reference like elements.

FIG. 10 is a diagram illustrating contents of decoding in a decoder.

DESCRIPTION OF EXEMPLARY EMBODIMENTS

Hereinafter, a preferred embodiment of the invention will be described with reference to the drawings. The drawings are used for easy descriptions. The embodiment described below does not unduly limit the contents of the invention described in the claims. Also, not all of the components described below are necessarily essential components of the invention.

An ink jet printer which is a printing device that ejects an ink as a liquid will be described below, as an example of a liquid ejecting apparatus according to the invention.

Examples of the liquid ejecting apparatus may include a printing device such as an ink jet printer; a coloring-material ejecting apparatus used in manufacturing a color filter in a liquid crystal display or the like; an electrode-material ejecting apparatus used in forming an electrode in an organic EL display, a surface-emitting display, or the like; and a bio-organic material ejecting apparatus used in manufacturing a biochip.

1. Configuration of Liquid Ejecting Apparatus

A printing device as an example of the liquid ejecting apparatus according to the embodiment is an ink jet printer that performs printing of an image which includes a figure, characters, and the like and corresponds to image data, in a manner that a dot is formed on a print medium such as paper by ejecting an ink in accordance with the image data supplied from an external host computer.

Figure 1:
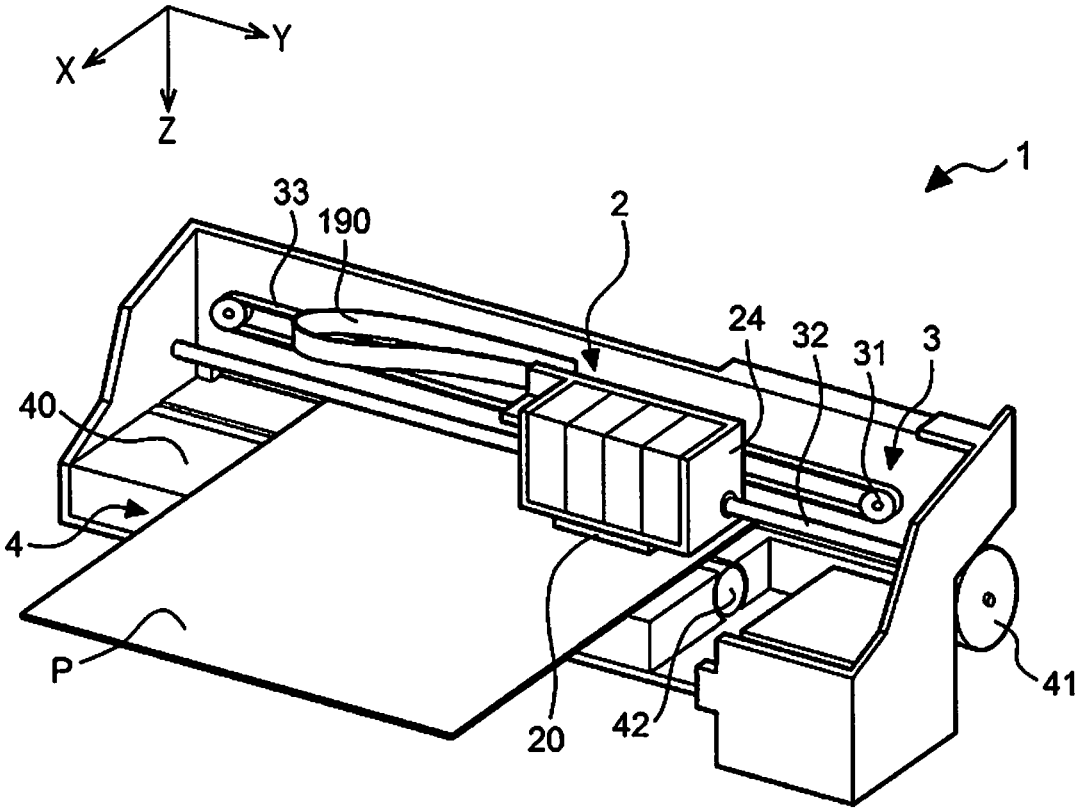
FIG. 1 is a perspective view illustrating an overall configuration of a liquid ejecting apparatus.

FIG. 1 is a perspective view illustrating an overall configuration of a liquid ejecting apparatus 1. FIG. 1 illustrates a direction X in which a medium P is transported, a direction Y which intersects with the direction X and in which a moving object 2 performs reciprocation, and a direction Z in which an ink is ejected. In the embodiment, descriptions will be made on the assumption that the direction X, the direction Y, and the direction Z correspond to axes orthogonal to each other.

As illustrated in FIG. 1, the liquid ejecting apparatus 1 includes the moving object 2 and a moving mechanism 3 that cause the moving object 2 to reciprocate in the direction Y.

The moving mechanism 3 includes a carriage motor 31 as a driving source of the moving object 2, a carriage guide shaft 32 having both fixed ends, and a timing belt 33 that extends substantially parallel to the carriage guide shaft 32 and is driven by the carriage motor 31.

A carriage 24 provided in the moving object 2 is supported by the carriage guide shaft 32 so as to freely reciprocate and is fixed to a portion of the timing belt 33. Therefore, if the timing belt 33 is driven by the carriage motor 31, the moving object 2 reciprocates in the direction Y with being guided by the carriage guide shaft 32.

A head unit 20 is provided at a portion of the moving object 2, which faces a medium P. The head unit 20 includes multiple nozzles. An ink is ejected from each of the nozzles in the direction Z. A control signal and the like are supplied to the head unit 20 via a flexible cable 190.

The liquid ejecting apparatus 1 includes a transport mechanism 4 that transports a medium P on a platen 40 in the direction X. The transport mechanism 4 includes a transport motor 41 as a driving source and a transport roller 42 that rotates by the transport motor 41 so as to transport the medium P in the direction X.

The head unit 20 ejects an ink onto a medium P at a timing at which the medium P is transported by the transport mechanism 4, and thereby an image is formed on a surface of the medium P.

Figure 2:
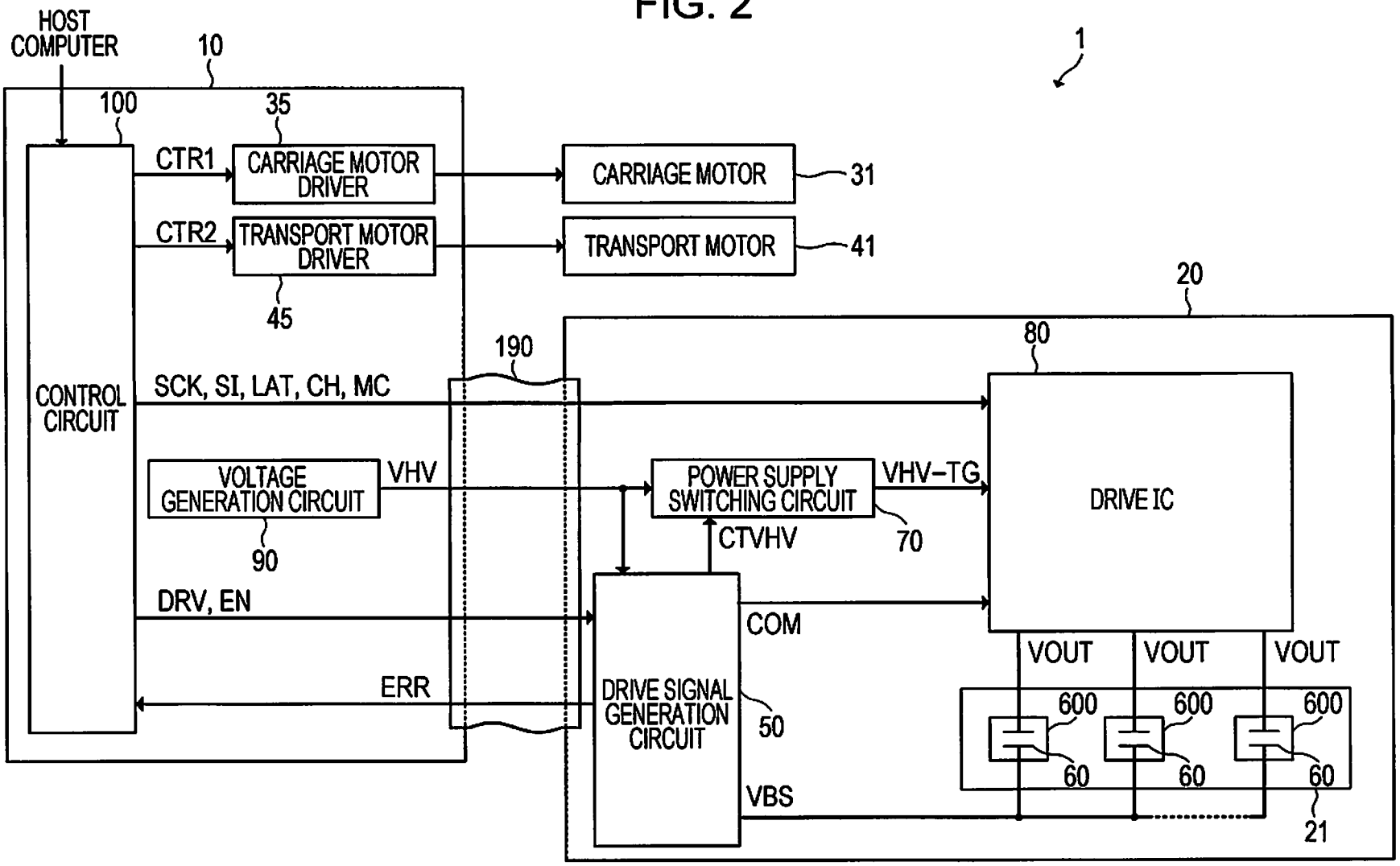
FIG. 2 is a block diagram illustrating an electrical configuration of the liquid ejecting apparatus.

FIG. 2 is a block diagram illustrating an electrical configuration of the liquid ejecting apparatus 1.

As illustrated in FIG. 2, the liquid ejecting apparatus 1 includes a control unit 10 and a head unit 20. The control unit 10 and the head unit 20 are connected to each other via the flexible cable 190.

The control unit 10 includes a control circuit 100, a carriage motor driver 35, a transport motor driver 45, and a voltage generation circuit 90.

The control circuit 100 supplies a plurality of control signals for controlling various components, based on image data supplied from the host computer.

Specifically, the control circuit 100 supplies a control signal CTR1 to the carriage motor driver 35. The carriage motor driver 35 drives the carriage motor 31 in accordance with the control signal CTR1. Thus, moving of the carriage 24 (illustrated in FIG. 1) in the direction Y is controlled.

The control circuit 100 supplies a control signal CTR2 to the transport motor driver 45. The transport motor driver 45 drives the transport motor 41 in accordance with the control signal CTR2. Thus, moving of the medium P by the transport mechanism 4 (illustrated in FIG. 1) in the direction X is controlled.

The control circuit 100 supplies a clock signal SCK, a print data signal SI, a latch signal LAT, a change signal CH, an operation mode signal MC, a drive data signal DRV, and a select signal EN to the head unit 20.

The voltage generation circuit 90 generates a voltage VHV having, for example, DC 42 V to the head unit 20. The voltage VHV may also be supplied to various components in the control unit 10.

The head unit 20 includes a drive signal generation circuit 50, a power supply switching circuit 70, a drive IC 80, and an ejection module 21.

The voltage VHV, the drive data signal DRV, and the select signal EN are supplied to the drive signal generation circuit 50.

The drive signal generation circuit 50 generates a drive signal COM by class-D amplifying a signal based on the drive data signal DRV to have a voltage based on the voltage VHV. Then, the drive signal generation circuit supplies the generated drive signal to the drive IC 80. The drive signal generation circuit 50 generates a criterion voltage signal VBS having, for example, DC 5 V by stepping down the voltage VHV, and supplies the generated criterion voltage signal to the ejection module 21. The drive signal generation circuit 50 generates a power-supply control signal CTVHV based on the drive data signal DRV and supplies the generated power-supply control signal to the power supply switching circuit 70. Here, the select signal EN is a signal for an instruction of whether the drive data signal DRV supplied to the drive signal generation circuit 50 is a data signal for generating the drive signal COM or a data signal for generating the power-supply control signal CTVHV.

In a case where the generated drive signal COM is not normal, the drive signal generation circuit 50 supplies an error signal ERR to the control circuit 100.

The voltage VHV and the power-supply control signal CTVHV are supplied to the power supply switching circuit 70. The power supply switching circuit 70 performs switching of whether the potential of a voltage VHV-TG supplied to the drive IC 80 has a potential based on the voltage VHV or has a ground potential, in accordance with the power-supply control signal CTVHV.

The clock signal SCK, the print data signal SI, the latch signal LAT, the change signal CH, the operation mode signal MC, the voltage VHV-TG, and the drive signal COM are supplied to the drive IC 80.

The drive IC 80 performs switching of whether or not the drive signal COM is selected in a predetermined period, based on the clock signal SCK, the print data signal SI, the operation mode signal MC, the latch signal LAT, and the change signal CH. The drive signal COM selected by the drive IC 80 is supplied to the ejection module 21 as a drive signal VOUT. The voltage VHV-TG is used for generating a signal of a high voltage logic, which is used for selecting the drive signal COM, for example.

The ejection module 21 includes a plurality of ejection units 600 including a piezoelectric element 60.

The drive signal VOUT supplied to the ejection module 21 is supplied to one end of the piezoelectric element 60. The criterion voltage signal VBS is supplied to the other end of the piezoelectric element 60. The piezoelectric element 60 performs displacement in accordance with a potential difference between the drive signal VOUT and the criterion voltage signal VBS. Thus, an ink of an amount depending on the displacement is ejected from the ejection unit 600.

Details of the drive signal generation circuit 50, the power supply switching circuit 70, the drive IC 80, and the ejection module 21 described above will be described later. FIG. 2 illustrates one head unit 20 provided in the liquid ejecting apparatus 1. However, a plurality of head units 20 may be provided. FIG. 2 illustrates one ejection module 21 provided in the head unit 20. However, a plurality of ejection modules 21 may be provided.

The liquid ejecting apparatus 1 as described above has a plurality of operation modes including a printing mode, a standby mode, a transfer mode, and a sleep mode.

The printing mode is an operation mode in which printing can be performed by ejecting an ink on a medium P based on the supplied image data. The standby mode is an operation mode in which printing can be performed for a short period in a case where image data has been supplied, while reducing consumed power in comparison to the printing mode. The transfer mode is an operation mode in a period in which the mode is transferred from the standby mode to the sleep mode. The sleep mode is an operation mode in which consumed power can be further reduced in comparison to the standby mode.

Figure 3:
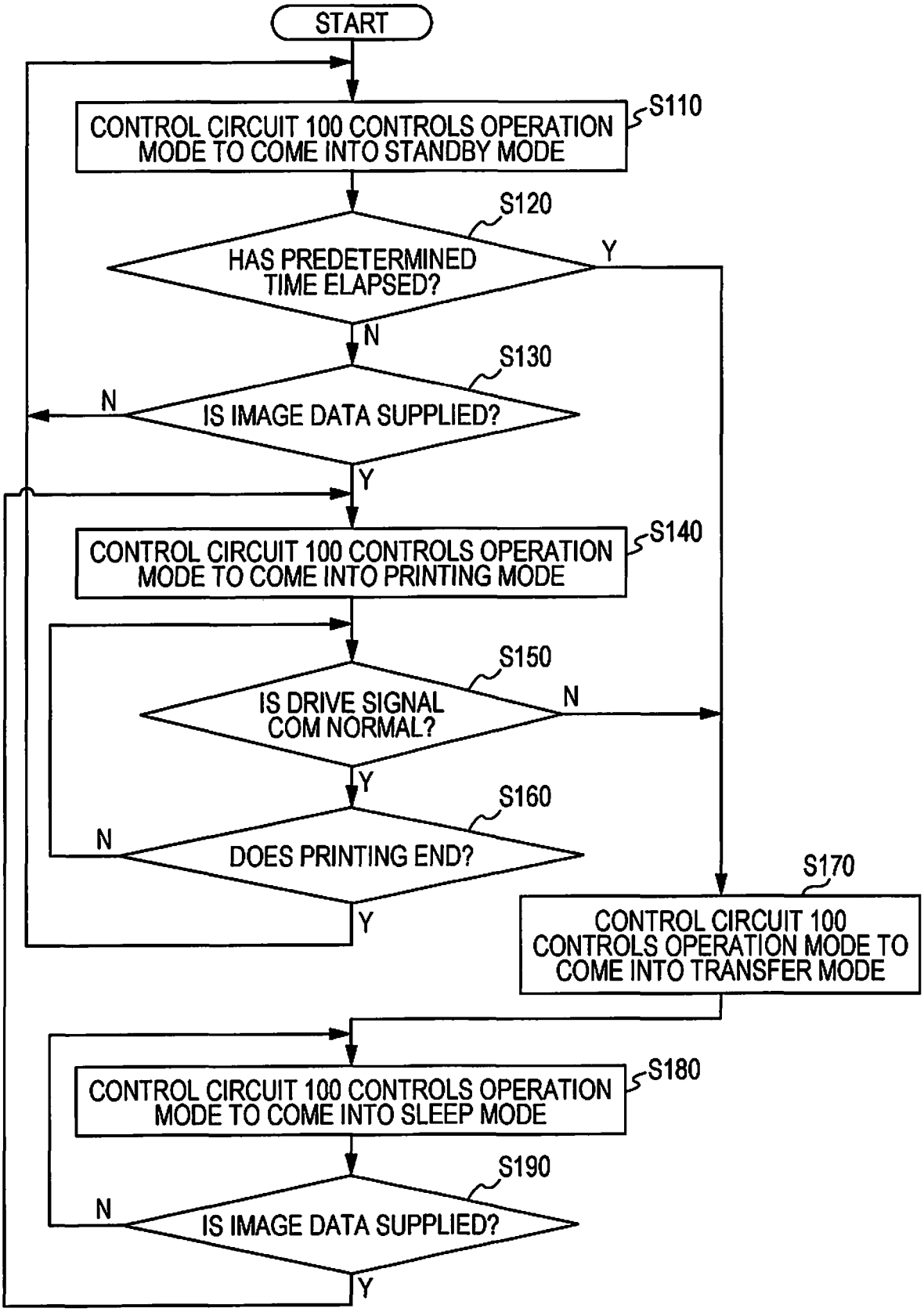
FIG. 3 is a flowchart illustrating a mode transition between operation modes in the liquid ejecting apparatus.

Here, a relationship between the operation modes of the liquid ejecting apparatus 1 will be described with reference to FIG. 3. FIG. 3 is a flowchart illustrating a mode transition between the operation modes in the liquid ejecting apparatus 1.

As illustrated in FIG. 3, if power is supplied to the liquid ejecting apparatus 1, the control circuit 100 controls the operation mode to come into the standby mode (S110). The control circuit 100 determines whether or not a predetermined time has elapsed after coming into the standby mode (S120).

In a case where the predetermined time does not have elapsed (N in S120), the control circuit 100 determines whether or not image data is supplied to the liquid ejecting apparatus 1 (S130).

In a case where the image data is not supplied (N in S130), the standby mode continues. In a case where the image data is supplied (Y in S130), the control circuit 100 controls the operation mode to come into the printing mode (S140).

In the printing mode, the drive signal generation circuit 50 determines whether or not the drive signal COM is normal (S150). In a case where the drive signal COM is normal (Y in S150), it is determined whether or not printing corresponding to the supplied image data ends (S160). In a case where the printing does not end (N in S160), the drive signal generation circuit 50 determines whether or not the drive signal COM is normal (S150).

In the printing mode, in a case where the printing corresponding to the supplied image data ends (Y in S160), the control circuit 100 controls the operation mode to come into the standby mode (S110).

In a case where the predetermined time has elapsed (Y in S120), and the drive signal COM is not normal (N in S150), the control circuit 100 controls the operation mode to come into the transfer mode (S170). After the transfer mode ends, the control circuit 100 controls the operation mode to come into the sleep mode (S180).

After the mode transitions to the sleep mode, the control circuit 100 determines whether or not image data is supplied to the liquid ejecting apparatus 1 (S190).

In a case where the image data is not supplied (N in S190), the sleep mode continues. In a case where the image data is supplied (Y in S190), the control circuit 100 controls the operation mode to come into the printing mode (S140).

The liquid ejecting apparatus 1 may include an operation mode in addition to the above-described operation modes, as the plurality of operation modes. For example, the liquid ejecting apparatus 1 may include an operation mode such as a test printing mode or a stop mode. In the test printing mode, test printing is performed on a medium P. In the stop mode, an operation is stopped due to running out of ink, poor transporting of a medium P, or the like.

2. Configuration and Operation of Drive Signal Generation Circuit

Figure 4:
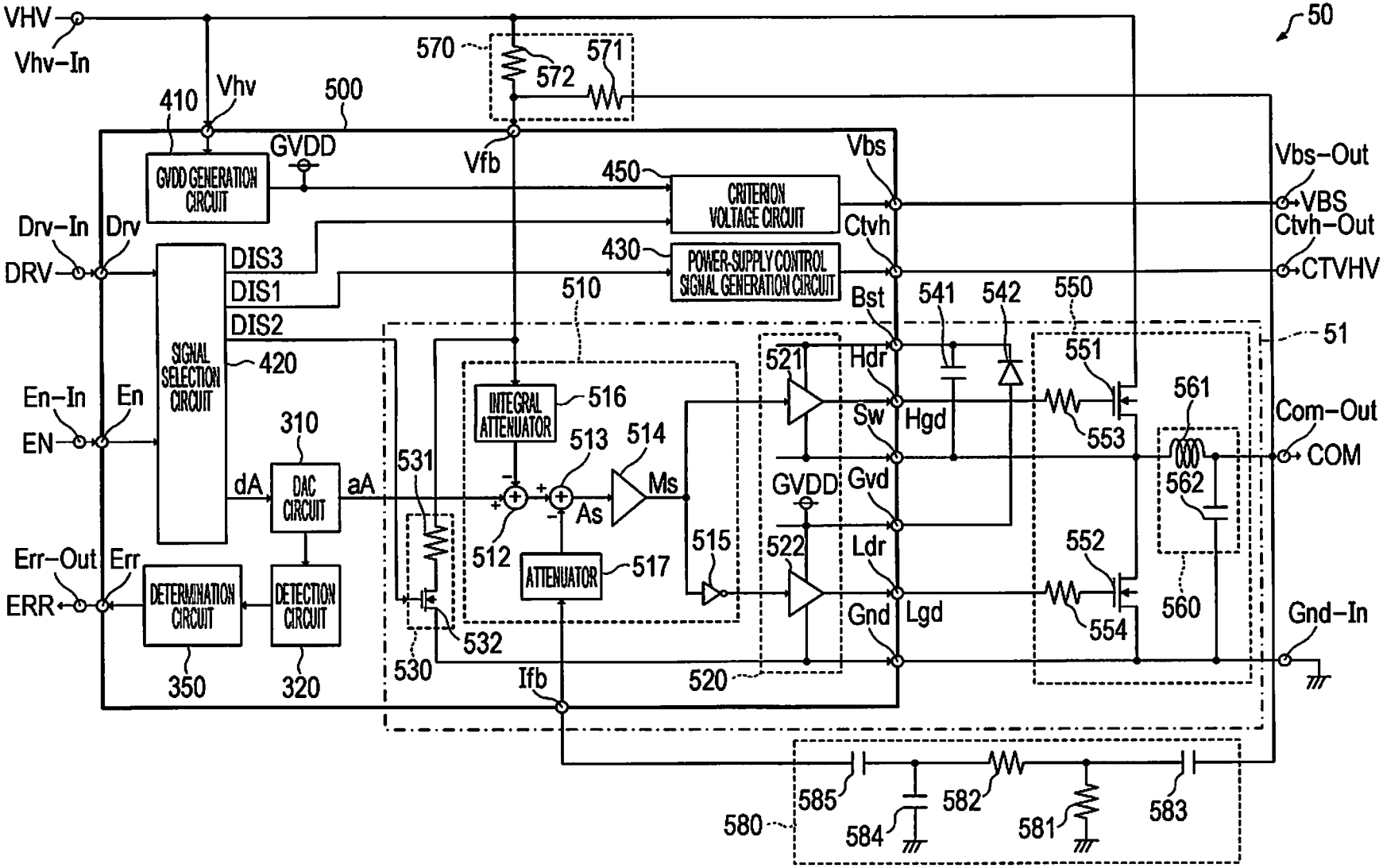
FIG. 4 is a block diagram illustrating a circuit configuration of a drive signal generation circuit.

Next, the drive signal generation circuit 50 will be described with reference to FIG. 4. FIG. 4 is a block diagram illustrating a circuit configuration of the drive signal generation circuit 50. As illustrated in FIG. 4, the drive signal generation circuit 50 includes an integrated circuit 500, an output circuit 550, a first feedback circuit 570, a second feedback circuit 580, and plurality of other circuit elements.

The drive signal generation circuit 50 has a plurality of terminals including terminals Drv-In, En-In, Err-Out, Vhv-In, Vbs-Out, Ctvh-Out, Com-Out, and Gnd-In, for electrical connections with various external components. A ground potential (for example, 0 V) is supplied to the terminal Gnd-In among the above terminals, in the liquid ejecting apparatus 1.

The integrated circuit 500 includes a GVDD generation circuit 410, a signal selection circuit 420, a power-supply control signal generation circuit 430, a criterion-voltage signal generation circuit 450, a digital-to-analog converter (DAC) circuit 310, a detection circuit 320, a determination circuit 350, a modulation circuit 510, a gate drive circuit 520, and an LC discharge circuit 530.

The integrated circuit 500 has a plurality of terminals including terminals Dry, En, Err, Vhv, Vfb, Vbs, Ctvh, Bst, Hdr, Sw, Gvd, Ldr, and Gnd for electrical connections with various components of the drive signal generation circuit 50.

The voltage VHV is supplied to the GVDD generation circuit 410 via the terminal Vhv-In and the terminal Vhv. The GVDD generation circuit 410 generates a voltage GVDD by changing the voltage of the voltage VHV and supplies the generated voltage GVDD to the criterion-voltage signal generation circuit 450 and the gate drive circuit 520.

The GVDD generation circuit 410 is constituted by, for example, a linear regulator circuit or a switching regulator circuit. The GVDD generation circuit 410 may be provided on the outside of the integrated circuit 500.

The drive data signal DRV is supplied to the signal selection circuit 420 via the terminal Drv-In and the terminal Dry, and the select signal EN is supplied to the signal selection circuit 420 via the terminal En-In and the terminal En. The signal selection circuit 420 determines whether the drive data signal DRV is a signal to be supplied to the DAC circuit 310 or a signal to be supplied to each of the criterion-voltage signal generation circuit 450, the power-supply control signal generation circuit 430, and the LC discharge circuit 530, based on the select signal EN. Then, the signal selection circuit supplies the drive data signal to the corresponding component.

Specifically, the signal selection circuit 420 includes a plurality of registers (not illustrated). In a case where the drive data signal DRV is a signal to be supplied to the DAC circuit 310, the signal selection circuit 420 holds the drive data signal DRV in a plurality of registers corresponding to the DAC circuit 310, in accordance with the select signal EN. The signal selection circuit 420 supplies the held signal as an original digital drive signal dA to the DAC circuit 310.

In a case where the drive data signal DRV is a signal to be supplied to each of the criterion-voltage signal generation circuit 450, the power-supply control signal generation circuit 430, and the LC discharge circuit 530, the signal selection circuit 420 holds data of the drive data signal DRV, which corresponds to each of the criterion-voltage signal generation circuit 450, the power-supply control signal generation circuit 430, and the LC discharge circuit 530, in a predetermined register in accordance with the select signal EN. The signal selection circuit 420 supplies the held signal as discharge control signals DIS1, DIS2, DIS3 to the power-supply control signal generation circuit 430, the LC discharge circuit 530, and the criterion-voltage signal generation circuit 450, respectively.

The discharge control signal DIS1 is supplied to the power-supply control signal generation circuit 430. The power-supply control signal generation circuit 430 includes an open drain circuit (not illustrated). In a case where the supplied discharge control signal DIS1 indicates being active, the power-supply control signal generation circuit 430 controls the open drain circuit to be in an OFF state and sets the terminal Ctvh to have high impedance.

In a case where the discharge control signal DIS1 indicates being inactive, the power-supply control signal generation circuit 430 controls the open drain circuit to be in an ON state and sets the terminal Ctvh to have a ground potential. At this time, the power-supply control signal CTVHV having an L level is supplied to the power supply switching circuit 70 illustrated in FIG. 2 via the terminal Ctvh and the terminal Ctvh-Out.

In descriptions of FIG. 20 and the like, which will be made later, the descriptions will be made on the assumption that the open drain circuit in the power-supply control signal generation circuit 430 is constituted by an NMOS transistor. The descriptions will be made on the assumption that the discharge control signal DIS1 is supplied to a gate terminal of the NMOS transistor via an inverter circuit. Thus, in the embodiment, a signal indicating that the discharge control signal DIS1 is active is a signal having an H level, and a signal indicating that the discharge control signal DIS1 is inactive is a signal having an L level. The power-supply control signal generation circuit 430 is not limited to the open drain circuit and may be constituted by a push-pull circuit.

The voltage GVDD is supplied to the criterion-voltage signal generation circuit 450. The criterion-voltage signal generation circuit 450 generates the criterion voltage signal VBS by stepping down the supplied voltage GVDD.

Figure 5:
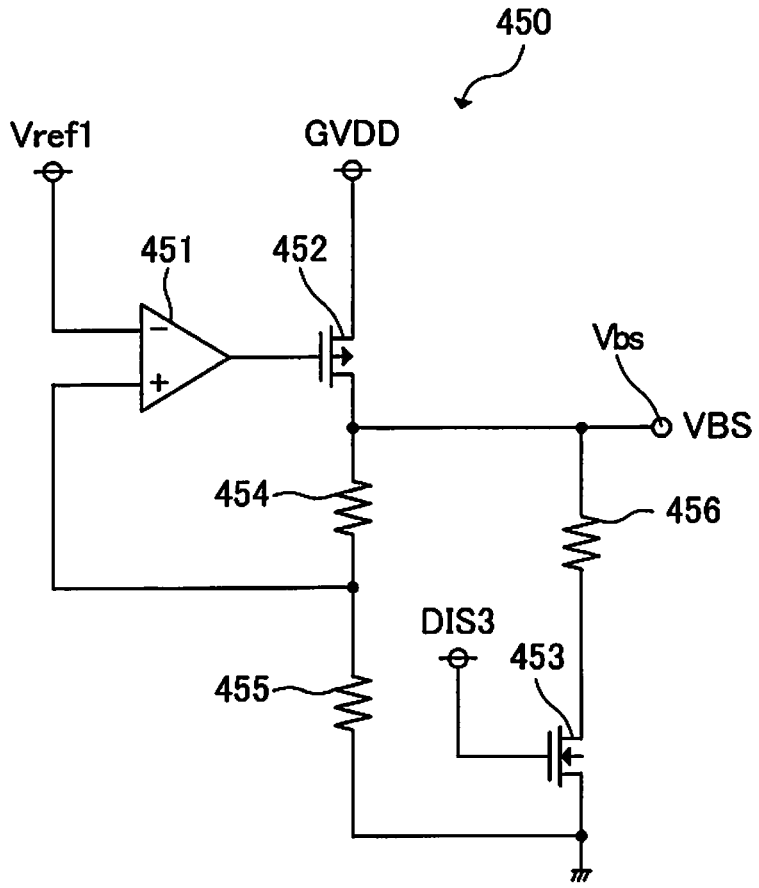
FIG. 5 is a circuit diagram illustrating a circuit configuration of a criterion-voltage signal generation circuit.

FIG. 5 is a circuit diagram illustrating a circuit configuration of the criterion-voltage signal generation circuit 450. The criterion-voltage signal generation circuit 450 includes a comparator 451, transistors 452 and 453, and resistors 454, 455, and 456. Descriptions will be made below on the assumption that the transistor 452 is a PMOS transistor, and the transistor 453 is an NMOS transistor.

A voltage Vref1 is supplied to an input end (−) of the comparator 451. An input end (+) of the comparator 451 is connected to one end of the resistor 454 and one end of the resistor 455. An output end of the comparator 451 is connected to a gate terminal of the transistor 452.

The voltage GVDD is supplied to a source terminal of the transistor 452. A drain terminal of the transistor 452 is commonly connected to the other end of the resistor 454, one end of the resistor 456, and a terminal Vbs from which the criterion voltage signal VBS is output.

The other end of the resistor 456 is connected to a drain terminal of the transistor 453.

The discharge control signal DIS3 is supplied to a gate terminal of the transistor 453. The ground potential is supplied to a source terminal of the transistor 453.

The ground potential is supplied to the other end of the resistor 455.

As described above, the criterion-voltage signal generation circuit 450 constitutes a series regulator circuit.

A voltage obtained by dividing the criterion voltage signal VBS by the resistor 454 and the resistor 455 is supplied to the input end (+) of the comparator 451. In a case where the voltage supplied to the input end (+) of the comparator 451 is higher than the voltage Vref1 supplied to the input end (−) of the comparator 451, the comparator 451 outputs a signal having an H level. At this time, the transistor 452 is controlled to be in the OFF state. Thus, the voltage GVDD is not supplied to the terminal Vbs.

In a case where the voltage supplied to the input end (+) of the comparator 451 is lower than the voltage Vref1 supplied to the input end (−) of the comparator 451, the comparator 451 outputs a signal having an L level. At this time, the transistor 452 is controlled to be in the ON state. Thus, the voltage GVDD is supplied to the terminal Vbs.

As described above, the criterion-voltage signal generation circuit 450 controls the transistor 452 by causing the comparator 451 to compare the signal based on the criterion voltage signal VBS to the voltage Vref1. Thereby, the criterion-voltage signal generation circuit 450 steps the voltage GVDD down and generates the criterion voltage signal VBS having an aimed voltage value.

In a case where the discharge control signal DIS3 supplied to the gate terminal of the transistor 453 has an H level, the transistor 453 is controlled to turn into the ON state. At this time, the ground potential is supplied to the terminal Vbs via the resistor 456. In other words, the transistor 453 is provided to be capable of switching an electrical connection between the terminal Vbs and the terminal Vbs-Out, and the ground potential. The transistor 453 is an example of a second switching circuit.

Returning to FIG. 4, the criterion voltage signal VBS generated by the criterion-voltage signal generation circuit 450 is supplied to the ejection module 21 illustrated in FIG. 2 via the terminal Vbs and the terminal Vbs-Out. The criterion voltage signal VBS functions as a criterion voltage used as a reference causing the piezoelectric element 60 to perform displacement. The terminal Vbs-Out from which the criterion voltage signal VBS from the criterion-voltage signal generation circuit 450 is output is an example of a third terminal.

The criterion-voltage signal generation circuit 450 may be provided on the outside of the integrated circuit 500, or may be provided on the outside of the drive signal generation circuit 50.

The DAC circuit 310 converts the original drive signal dA into an original analog drive signal aA and supplies the original analog drive signal to the modulation circuit 510. The DAC circuit 310 supplies a digital signal based on the original drive signal dA to the detection circuit 320.

The detection circuit 320 determines whether or not the signal which is based on the original drive signal dA and is supplied from the DAC circuit 310 is within a predetermined range.

The determination circuit 350 determines whether or not the original drive signal dA is normal, in accordance with a detection result of the detection circuit 320. In a case where it is determined that the original drive signal dA is not normal, the determination circuit 350 generates the error signal ERR and supplies the generated error signal ERR to the control circuit 100 illustrated in FIG. 2 via the terminal Err and the terminal Err-Out.

The modulation circuit 510 includes an adder 512, an adder 513, a comparator 514, an inverter 515, an integral attenuator 516, and an attenuator 517.

The integral attenuator 516 attenuates and integrates a voltage signal of the drive signal COM supplied via the terminal Vfb, and then supplies the voltage signal to an input end (−) of the adder 512.

The original drive signal aA is supplied to the input end (+) of the adder 512. The adder 512 subtracts a voltage signal supplied from the integral attenuator 516 to the input end (−) of the adder 512, from the original drive signal aA supplied to the input end (+) thereof. Then, the adder 512 performs integration. A voltage signal obtained by the subtraction and the integration is supplied to the input end (+) of the adder 513.

Here, although the maximum voltage of the original drive signal aA is a low voltage of, for example, about 2 V, the maximum voltage of the drive signal COM is a high voltage of, for example, about 40 V. Therefore, the integral attenuator 516 attenuates the voltage of the drive signal COM in order to cause the amplitude ranges of both the voltage to match with each other when the deviation is obtained.

The attenuator 517 attenuates a high-frequency component of the voltage signal of the drive signal COM input via the terminal Ifb and supplies the voltage to the input end (−) of the adder 513.

The adder 513 subtracts a voltage supplied from the attenuator 517 to the input end (−), from the voltage supplied from the adder 512 to the input end (+), and outputs a voltage signal As as a result of the subtraction to the comparator 514.

The voltage signal As output from the adder 513 is a voltage obtained by subtracting the voltage supplied to the terminal Vfb from the voltage of the original drive signal aA and further subtracting the voltage supplied to the terminal Ifb. That is, the voltage signal As is a voltage signal obtained in a manner that a deviation obtained by subtracting an attenuation voltage of the drive signal COM to be output, from the voltage of the aimed original drive signal aA is corrected with the high-frequency component of the drive signal COM.

The comparator 514 generates a modulation signal Ms based on the voltage signal As supplied from the adder 513. Specifically, in a case where the voltage of the voltage signal As supplied from the adder 513 rises and is equal to or higher than a predetermined threshold Vth1, the comparator 514 generates a modulation signal Ms having an H level. In a case where the voltage of the voltage signal As is lowered and is lower than a predetermined threshold Vth2, the comparator 514 generates a modulation signal Ms having an L level. The threshold Vth1 and the threshold Vth2 are set to have a relationship of threshold Vth1>threshold Vth2.

The comparator 514 supplies the generated modulation signal Ms to a first gate driver 521 provided in the gate drive circuit 520. The comparator 514 supplies the generated modulation signal Ms to a second gate driver 522 provided in the gate drive circuit 520, via an inverter 515. Thus, a signal supplied from the comparator 514 to the first gate driver 521 and a signal supplied to the second gate driver 522 have logical levels which have an exclusive relationship.

Here, the phrase that the logical levels of the signals supplied to the first gate driver 521 and the second gate driver 522 have an exclusive relationship includes a concept that a timing is controlled such that the logical levels of the signals supplied to the first gate driver 521 and the second gate driver 522 do not have simultaneously an H level.

The gate drive circuit 520 includes the first gate driver 521 and the second gate driver 522.

The first gate driver 521 level-shifts the voltage value of the modulation signal Ms output from the comparator 514 and then outputs a signal obtained by the shift from the terminal Hdr as a first amplification control signal Hgd.

Specifically, a voltage is supplied to a high-potential side of the power-supply voltage of the first gate driver 521 via the terminal Bst, and a voltage is supplied to a low-potential side via the terminal Sw. The terminal Bst is commonly connected to one end of a capacitor 541 provided on the outside of the integrated circuit 500 and a cathode terminal of a diode 542 for preventing a backflow. The other end of the capacitor 541 is connected to the terminal Sw. The anode terminal of the diode 542 is connected to the terminal Gvd to which the voltage GVDD is supplied. Thus, a potential difference between the terminal Bst and the terminal Sw is substantially equal to a potential difference between both the ends of the capacitor 541, that is, the voltage GVDD. The first gate driver 521 generates the first amplification control signal Hgd having a voltage larger than the voltage at the terminal Sw by the voltage GVDD, in accordance with the input modulation signal Ms. Then, the first gate driver outputs the generated first amplification control signal from the terminal Hdr.

The second gate driver 522 operates on a potential side lower than the first gate driver 521. The second gate driver 522 level-shifts the voltage value of a signal obtained by the inverter 515 inverting the modulation signal Ms output from the comparator 514. Then, the second gate driver outputs a signal obtained by the shift, from the terminal Ldr as a second amplification control signal Lgd.

Specifically, the voltage GVDD is supplied to a high-potential side of the power-supply voltage of the second gate driver 522, and the ground potential is supplied to a low-potential side. The second gate driver 522 generates the second amplification control signal Lgd having a voltage which is larger than the voltage at the terminal Gnd by the voltage GVDD, in accordance with the inverted signal of the supplied modulation signal Ms. Then, the second gate driver outputs the second amplification control signal from the terminal Ldr.

The LC discharge circuit 530 includes a resistor 531 and a transistor 532. In the following descriptions, descriptions will be made on the assumption that the transistor 532 is an NMOS transistor.

One end of the resistor 531 is connected to the terminal Vfb. The other end of the resistor 531 is connected to a drain terminal of the transistor 532.

The discharge control signal DIS2 is supplied to a gate terminal of the transistor 532. The ground potential is supplied to a source terminal of the transistor 532.

In a case where the discharge control signal DIS2 having an H level is supplied to the gate terminal of the transistor 532, the transistor 532 is controlled to turn into the ON state. At this time, the ground potential is supplied to the terminal Com-Out to which the drive signal COM is output, via resistors 531 and 571 and the transistor 532. In other words, the transistor 532 is provided to be capable of switching an electrical connection between the terminal Com-Out and the ground potential. The transistor 532 is an example of a third switching circuit.

The output circuit 550 includes transistors 551 and 552, resistors 553 and 554, and a low pass filter 560. In the following descriptions, descriptions will be made on the assumption that the transistors 551 and 552 are NMOS transistors.

The voltage VHV is supplied to a drain terminal of the transistor 551. A gate terminal of the transistor 551 is connected to one end of the resistor 553. A source terminal of the transistor 551 is connected to the terminal Sw. The other end of the resistor 553 is connected to the terminal Hdr. Thus, the first amplification control signal Hgd is supplied to the gate terminal of the transistor 551.

A drain terminal of the transistor 552 is connected to the source terminal of the transistor 551. A gate terminal of the transistor 552 is connected to one end of the resistor 554. The ground potential is supplied to a source terminal of the transistor 552. The other end of the resistor 554 is connected to the terminal Ldr. Thus, the second amplification control signal Lgd is supplied to the gate terminal of the transistor 552.

In the transistors 551 and 552 connected in the above-described manner, in a case where the transistor 551 is controlled to be in the OFF state, and the transistor 552 is controlled to be in the ON state, a connection point connected to the terminal Sw has the ground potential, and the voltage GVDD is supplied to the terminal Bst. In a case where the transistor 551 is controlled to be in the ON state, and the transistor 552 is controlled to be in the OFF state, the voltage VHV is supplied to the connection point connected to the terminal Sw. Thus, a voltage obtained by adding the voltage VHV and the voltage GVDD is supplied to the terminal Bst. That is, the voltage of the terminal Sw changes to the ground potential and the voltage VHV in accordance with operations of the transistors 551 and 552, by using the capacitor 541 as a floating power supply. Thereby, the first gate driver 521 that drives the transistor 551 supplies the first amplification control signal Hgd having the voltage VHV as an L level and the voltage of the voltage VHV+ the voltage GVDD as an H level, to the gate terminal of the transistor 551. The transistor 551 performs a switching operation based on the first amplification control signal Hgd.

The second gate driver 522 that drives the transistor 552 outputs the second amplification control signal Lgd having the ground potential as an L level and the voltage GVDD as an H level, regardless of the operations of the transistors 551 and 552. The transistor 552 performs a switching operation based on the second amplification control signal Lgd.

Accordingly, an amplification modulation signal obtained by amplifying the modulation signal Ms based on the voltage VHV is generated at the connection point between the source terminal of the transistor 551 and the drain terminal of the transistor 552. That is, the transistors 551 and 552 function as an amplification circuit that amplifies the voltage of the modulation signal Ms. As described above, the first amplification control signal Hgd and the second amplification control signal Lgd for driving the transistors 551 and 552 have an exclusive relationship. That is, the transistor 551 and the transistor 552 are controlled not to simultaneously in the ON state.

The low pass filter 560 includes an inductor 561 and a capacitor 562.

One end of the inductor 561 is commonly connected to the source terminal of the transistor 551 and the drain terminal of the transistor 552. The other end of the inductor 561 is commonly connected to the terminal Com-Out from which the drive signal COM is output and one end of the capacitor 562. The ground potential is supplied to the other end of the capacitor 562.

In this manner, the inductor 561 and the capacitor 562 smooth the amplification modulation signal supplied to the connection point between the transistor 551 and the transistor 552. Thus, the drive signal COM is generated by demodulating the amplification modulation signal.

The first feedback circuit 570 includes a resistor 571 and a resistor 572. One end of the resistor 571 is connected to the terminal Com-Out. The other end of the resistor 571 is commonly connected to the terminal Vfb and one end of the resistor 572. The voltage VHV is supplied to the other end of the resistor 572. Thus, the drive signal COM passing from the terminal Com-Out through the first feedback circuit 570 is pulled up and then is fed back to the terminal Vfb.

The second feedback circuit 580 includes resistors 581 and 582 and capacitors 583, 584, and 585.

One end of the capacitor 583 is connected to the terminal Com-Out. The other end of the capacitor 583 is commonly connected to one end of the resistor 581 and one end of the resistor 582. The ground potential is supplied to the other end of the resistor 581. Thus, the capacitor 583 and the resistor 581 function as a high pass filter. The cutoff frequency of the high pass filter constituted by the capacitor 583 and the resistor 581 is set to about 9 MHz, for example.

The other end of the resistor 582 is commonly connected to one end of the capacitor 584 and one end of the capacitor 585. The ground potential is supplied to the other end of the capacitor 584. Thus, the resistor 582 and the capacitor 584 function as a low pass filter. The cutoff frequency of the high pass filter constituted by the resistor 582 and the capacitor 584 is set to about 160 MHz, for example.

As described above, the second feedback circuit 580 is constituted by the high pass filter and the low pass filter. Thus, the second feedback circuit 580 functions as a band pass filter that causes a predetermined frequency band of the drive signal COM to pass therethrough.

The other end of the capacitor 585 is connected to the terminal Ifb. Thus, a DC component is cut off from the high-frequency component of the drive signal COM by the drive signal passing through the second feedback circuit 580, and the resultant of the cutoff is fed back to the terminal Ifb.

The drive signal COM is a signal obtained by smoothing the amplification modulation signal with the low pass filter 560. The drive signal COM is fed back to the adder 512 in a state of being integrated and subtracted via the terminal Vfb. Thus, self-oscillation occurs at a frequency determined by a feedback delay and a feedback transfer function. However, the delay degree of a feedback path via the terminal Vfb is large. Thus, it may not possible that the frequency of the self-oscillation is set to be as high as accuracy of the drive signal COM can be sufficiently secured, only by the feedback via the terminal Vfb. Thus, a path of feeding a high-frequency component of the drive signal COM via the terminal Ifb is provided in addition to the path via the terminal Vfb, and thereby it is possible to reduce the delay in the entirety of the circuit. Accordingly, the frequency of the voltage signal As is set to be as high as the accuracy of the drive signal COM can be sufficiently secured, in comparison to a case where the path via the terminal Ifb is not provided.

In the above-described drive signal generation circuit 50, a configuration including the modulation circuit 510, the gate drive circuit 520, the LC discharge circuit 530, the output circuit 550, the capacitor 541, and the diode 542 corresponds to the above-described drive circuit 51 that generates the drive signal COM. The terminal Com-Out from which the drive signal COM is output is an example of a fourth terminal.

3. Configuration and Operation of Power Supply Switching Circuit

Figure 6:
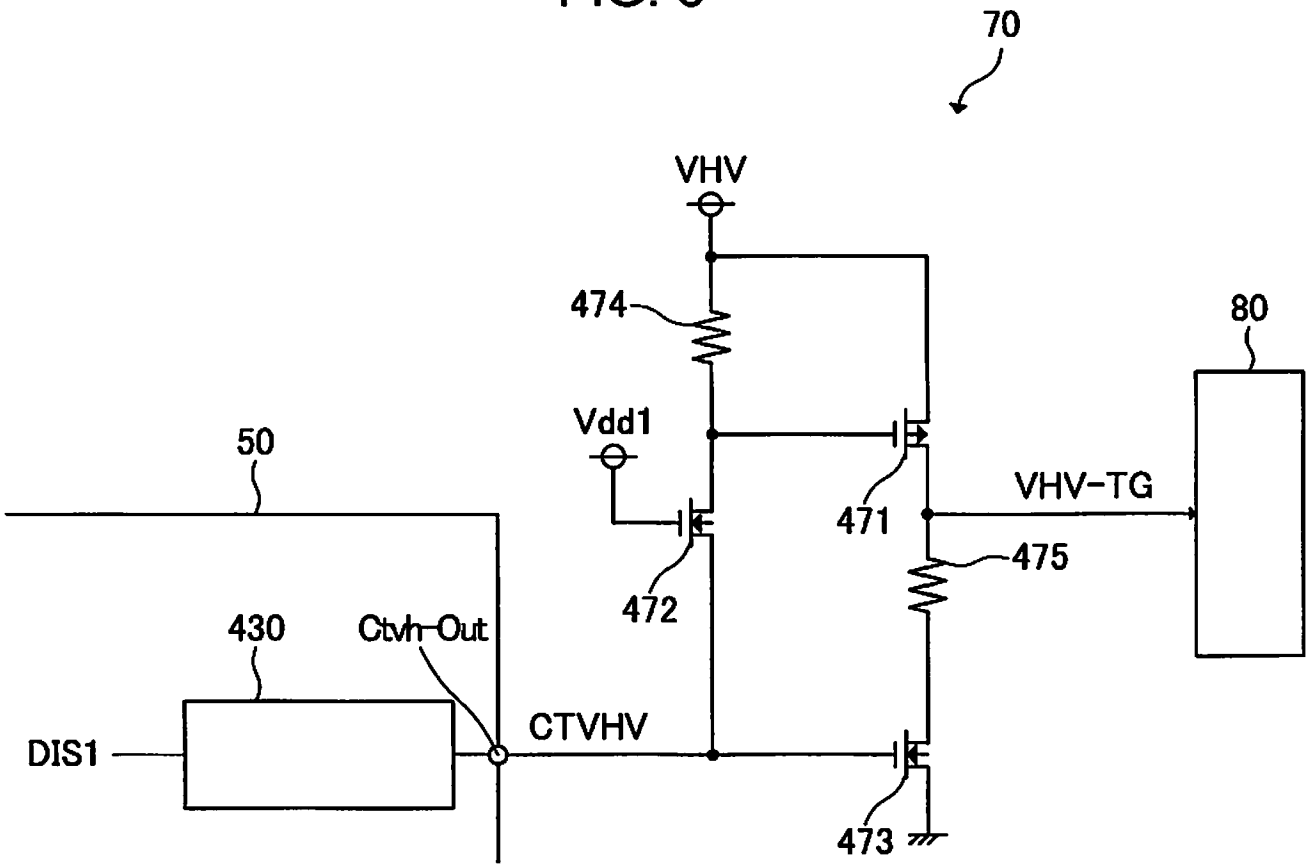
FIG. 6 is a circuit diagram illustrating an electrical configuration of a power supply switching circuit.

Next, a configuration and an operation of the power supply switching circuit 70 will be described with reference to FIG. 6. FIG. 6 is a circuit diagram illustrating an electrical configuration of the power supply switching circuit 70.

The power supply switching circuit 70 includes transistors 471, 472, and 473 and resistors 474 and 475. Descriptions will be made below on the assumption that the transistor 471 is a PMOS transistor, and the transistors 472 and 473 are NMOS transistors.

The voltage VHV is supplied to a source terminal of the transistor 471 and one end of the resistor 474. A gate terminal of the transistor 471 is commonly connected to the other end of the resistor 474 and a drain terminal of the transistor 472. A drain terminal of the transistor 471 is connected to one end of the resistor 475.

A voltage Vdd1 is supplied to a gate terminal of the transistor 472. A source terminal of the transistor 472 is connected to a gate terminal of the transistor 473. The power-supply control signal CTVHV is supplied to the source terminal of the transistor 472. Here, the voltage Vdd1 is a DC voltage signal having a predetermined voltage value.

A drain terminal of the transistor 473 is connected to the other end of the resistor 475. The ground potential is supplied to a source terminal of the transistor 473.

The power supply switching circuit 70 constituted as described above performs switching of whether or not the voltage VHV is supplied to the drive IC 80 as the voltage VHV-TG, in accordance with the power-supply control signal CTVHV supplied from the drive signal generation circuit 50.

Specifically, in a case where the discharge control signal DIS1 indicating being inactive is supplied to the power-supply control signal generation circuit 430, the power-supply control signal generation circuit 430 sets the terminal Ctvh-Out to have a ground potential. Thus, the power-supply control signal CTVHV becomes a signal having an L level. Thus, the transistor 473 is controlled to be in the OFF state, and the transistor 472 is controlled to be in the ON state. Thus, the ground potential is supplied to the gate terminal of the transistor 471 via the transistor 472. Accordingly, the transistor 471 is controlled to be in the ON state.

As described above, in a case where the power-supply control signal CTVHV is a signal having an L level, the transistor 471 is controlled to be in the ON state, and the transistor 473 is controlled to be in the OFF state. Thus, the power supply switching circuit 70 supplies the voltage VHV supplied via the transistor 471, to the drive IC 80 as the voltage VHV-TG.

In a case where the discharge control signal DIS1 indicating being active is supplied to the power-supply control signal generation circuit 430, the power-supply control signal generation circuit 430 sets the terminal Ctvh-Out to have high impedance. At this time, the voltage at the terminal Ctvh-Out is the voltage Vdd1 supplied via the transistor 472. In other words, the power-supply control signal CTVHV becomes a signal having an H level. Thus, the transistor 473 is controlled to be in the ON state. At this time, the voltage VHV is supplied to the drain terminal of the transistor 472 and the gate terminal of the transistor 471 via the resistor 474. Thus, the transistor 471 is controlled to be in the OFF state.

As described above, in a case where the power-supply control signal CTVHV is a signal having an H level, the transistor 471 is controlled to be in the OFF state, and the transistor 473 is controlled to be in the ON state. Accordingly, the power supply switching circuit 70 supplies the ground potential supplied via the resistor 475 and the transistor 472, to the drive IC 80 as the voltage VHV-TG.

4. Configuration and Operation of Drive IC

Next, a configuration and an operation of the drive IC 80 will be described.

Firstly, an example of the drive signal COM supplied to the drive IC 80 will be described with reference to FIG. 7. Then, the configuration and the operation of the drive IC 80 will be described with reference to FIGS. 8 to 11.

Figure 7:
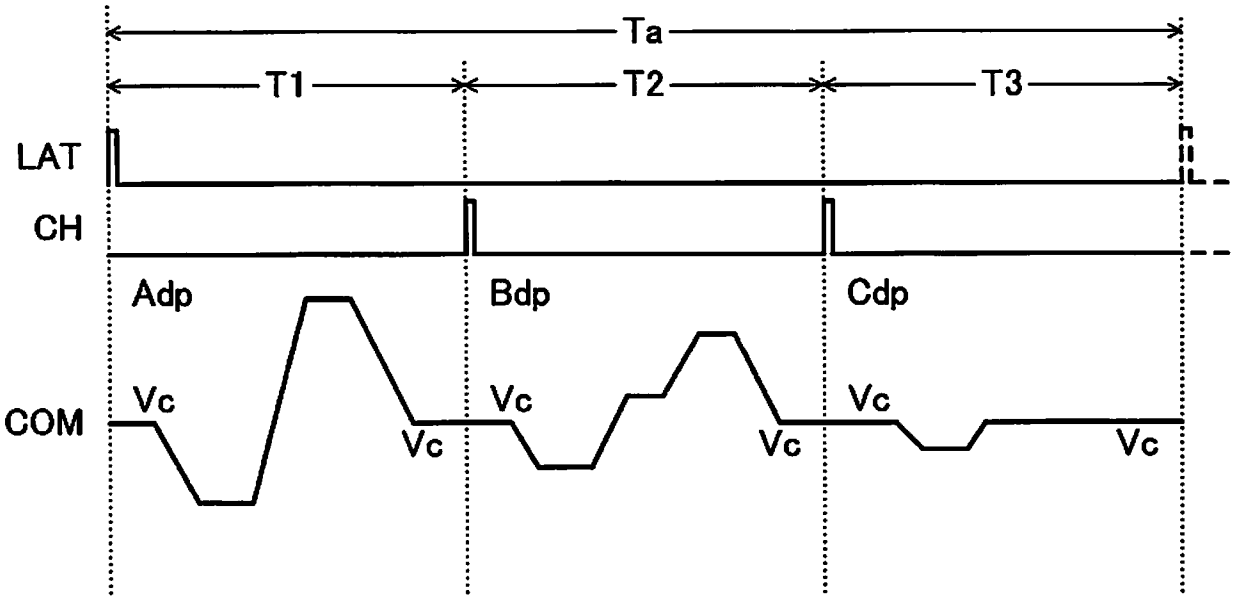
FIG. 7 is a diagram illustrating an example of a drive signal in a printing mode.

FIG. 7 is a diagram illustrating an example of a drive signal COM in the printing mode. FIG. 7 illustrates a period T1, a period T2, and a period T3. The period T1 is a period from a rising edge of the latch signal LAT to a rising edge of the change signal CH. The period T2 is a period until the next rising edge of the change signal CH after the period T1. The period T3 is a period until a rising edge of the latch signal LAT after the period T2. A cycle including the periods T1, T2, and T3 is set as a cycle Ta at which a new dot is formed on a medium P.

As illustrated in FIG. 7, in the printing mode, the drive signal generation circuit 50 generates a voltage waveform Adp in the period T1. In a case where the voltage waveform Adp1 is supplied to the piezoelectric element 60, an ink of a predetermined amount, specifically, a median amount is ejected from the corresponding ejection unit 600.

The drive signal generation circuit 50 generates a voltage waveform Bdp in the period T2. In a case where the voltage waveform Bdp is supplied to the piezoelectric element 60, the ink of a small amount which is smaller than the predetermined amount is ejected from the corresponding ejection unit 600.

The drive signal generation circuit 50 generates a voltage waveform Cdp in the period T3. In a case where the voltage waveform Cdp is supplied to the piezoelectric element 60, the piezoelectric element 60 performs displacement as small as the ink is not ejected from the corresponding ejection unit 600. Thus, a dot is not formed on the medium P. The voltage waveform Cdp is a voltage waveform for preventing an increase of viscosity of an ink by finely vibrating the ink in the vicinity of an aperture portion of a nozzle in the ejection unit 600. In the following descriptions, causing the piezoelectric element 60 to perform displacement as much as the ink is not ejected from the ejection unit 600 in order to prevent an increase of the viscosity of the ink is referred to as "fine vibration".

Here, all of voltage values at start timings of the voltage waveform Adp, the voltage waveform Bdp, and the voltage waveform Cdp and voltage values at end timings thereof commonly correspond to a voltage Vc. That is, the voltage waveforms Adp, Bdp, and Cdp are voltage waveforms in which a voltage value starts at the voltage Vc and ends at the voltage Vc. Thus, in the printing mode, the drive signal generation circuit 50 outputs the drive signal COM having a voltage waveform in which the voltage waveforms Adp, Bdp, and Cdp are consecutive in the cycle Ta.

If the voltage waveform Adp is supplied to the piezoelectric element 60 in the period T1, and the voltage waveform Bdp is supplied to the piezoelectric element 60 in the period T2. Thus, an ink of a median amount and an ink of a small amount are ejected from the ejection unit 600 in the cycle Ta. Accordingly, "a large dot" is formed on the medium P. If the voltage waveform Adp is supplied to the piezoelectric element 60 in the period T1, and the voltage waveform Bdp is not supplied to the piezoelectric element 60 in the period T2, the ink of a median amount is ejected from the ejection unit 600 in the cycle Ta. Accordingly, "a medium dot" is formed on the medium P. If the voltage waveform Adp is not supplied to the piezoelectric element 60 in the period T1, and the voltage waveform Bdp is supplied to the piezoelectric element 60 in the period T2, the ink of a small amount is ejected from the ejection unit 600 in the cycle Ta. Accordingly, "a small dot" is formed on the medium P. If the voltage waveforms Adp and Bdp are not supplied to the piezoelectric element 60 in the periods T1 and T2, and the voltage waveform Cdp is supplied to the piezoelectric element 60 in the period T3, fine vibration is performed without ejecting the ink from the ejection unit 600, in the cycle Ta. In this case, a dot is not formed on the medium P.

Next, an example of the drive signal COM in the standby mode, the transfer mode, and the sleep mode will be described. The illustration of the example of the drive signal COM in the standby mode, the transfer mode, and the sleep mode will be omitted.

In a case of the standby mode, the transfer mode, and the sleep mode, an ink is not ejected to a medium P. Thus, the periods T1, T2, and T3 are not defined. Thus, in the standby mode, the transfer mode, and the sleep mode, the latch signal LAT and the change signal CH have an L level.

In the standby mode, the drive signal generation circuit 50 performs control such that the voltage value of the drive signal COM approaches the voltage value of the criterion voltage signal VBS.

In the sleep mode, the drive signal generation circuit 50 stops an operation. Here, the phrase that the drive signal generation circuit 50 stops the operation means a case where the drive data signal DRV for stopping generation of the drive signal COM is supplied to the drive signal generation circuit 50, specifically, a case where the drive signal generation circuit 50 outputs the ground potential as the drive signal COM.

As described above, the transfer mode is an operation mode in a period in which the mode is transferred from the standby mode to the sleep mode. In the embodiment, the drive signal generation circuit 50 performs control such that the voltage value of the drive signal COM approaches the voltage value of the criterion voltage signal VBS before transition of the transfer mode. The drive signal generation circuit stops the operation after the transition of the transfer mode.

Figure 8:
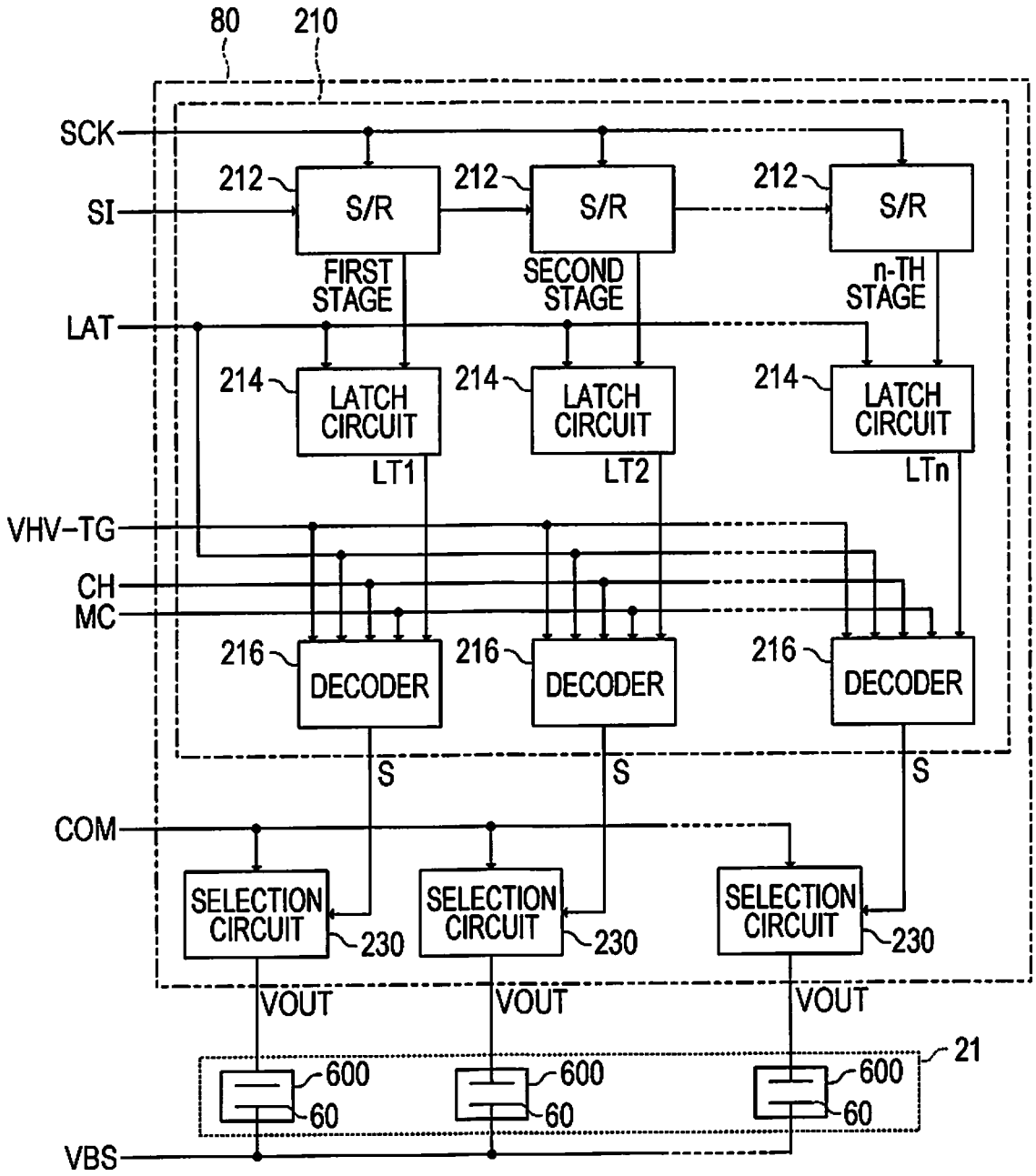
FIG. 8 is a block diagram illustrating an electrical configuration of an ejection module and a drive IC.

FIG. 8 is a block diagram illustrating an electrical configuration of the ejection module 21 and the drive IC 80. As illustrated in FIG. 8, the drive IC 80 includes a selection control circuit 210 and a plurality of selection circuits 230.

The clock signal SCK, the print data signal SI, the latch signal LAT, the change signal CH, the operation mode signal MC, and the voltage VHV-TG are supplied to the selection control circuit 210. A set of a shift register (S/R) 212, a latch circuit 214, and a decoder 216 is provided in the selection control circuit 210, so as to correspond to each ejection unit 600. That is, sets of the shift registers 212, the latch circuits 214, and the decoders 216, of which the number is equal to the total number n of the ejection unit 600, are provided in the head unit 20.

The shift register 212 holds two-bit print data [SIH, SIL] included in a print data signal SI, for each corresponding ejection unit 600.

In detail, shift registers 212 of which the stage number corresponds to the ejection unit 600 are continuously connected to each other, and the print data signal SI supplied in serial is sequentially transferred to the subsequent stages in accordance with the clock signal SCK. In FIG. 8, in order to distinguish the shift registers 212 from each other, the shift registers 212 are marked as a first stage, a second stage, . . . , and an n-th stage in order from an upstream side to which the print data signal SI is supplied.

Each of latch circuits 214 of which the number is n latches the print data [SIH, SIL] held in the corresponding shift register 212, at the rising edge of the latch signal LAT.

Each of decoders 216 of which the number is n generates a selection signal S by decoding the two-bit print data [SIH, SIL] latched by the corresponding latch circuit 214 and two-bit operation mode data [MCH, MCL] in the operation mode signal MC. Then, each of the decoders 216 supplies the generated selection signal S to the selection circuit 230.

The selection circuits 230 are provided to correspond to the ejection units 600, respectively. That is, the number of selection circuits 230 in one head unit 20 is equal to the total number n of the ejection units 600 in the head unit 20. The selection circuit 230 controls a supply of the drive signal COM to the piezoelectric element 60 based on the selection signal S supplied from the decoder 216. The selection circuit 230 is an example of a first switching circuit.

Figure 9:
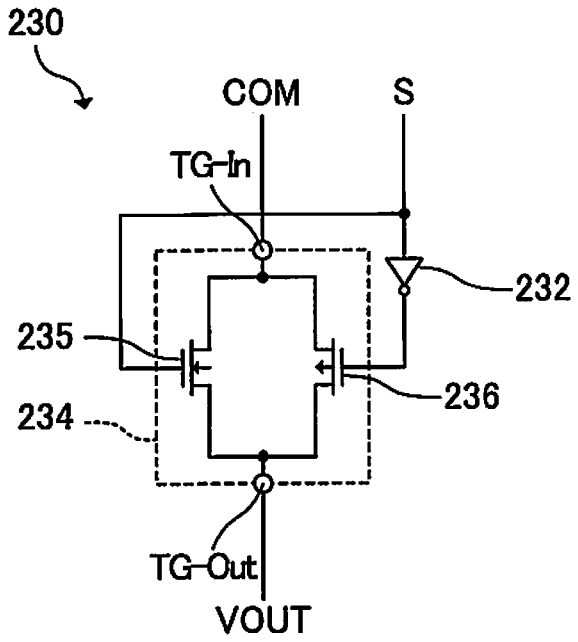
FIG. 9 is a circuit diagram illustrating an electrical configuration of a selection circuit.

FIG. 9 is a circuit diagram illustrating an electrical configuration of the selection circuit 230 corresponding to one ejection unit 600.

As illustrated in FIG. 9, the selection circuit 230 includes an inverter (NOT circuit) 232 and a transfer gate 234. The transfer gate 234 includes a transistor 235 which is an NMOS transistor and a transistor 236 which is a PMOS transistor.

The selection signal S is supplied from the decoder 216 to a gate terminal of the transistor 235. The logic of the selection signal S is inverted by the inverter 232, and the signal having the inverted logic is supplied to a gate terminal of the transistor 236.

A drain terminal of the transistor 235 and a source terminal of the transistor 236 are connected to a terminal TG-In. The drive signal COM is supplied to the terminal TG-In. If the transistor 235 and the transistor 236 are controlled to be in the ON or OFF state, in accordance with the selection signal S, the drive signal VOUT is output from a terminal TG-Out which is commonly connected to a source terminal of the transistor 235 and a drain terminal of the transistor 236, and then is supplied to the ejection module 21. The terminal TG-In corresponds to the above-described first terminal. The terminal TG-Out is an example of "a second terminal". In the following descriptions, a case where the transistor 235 and the transistor 236 in the transfer gate 234 are controlled to be in a conductive state is referred to as controlling of the transfer gate 234 to be in the ON state. In addition, a case where the transistor 235 and the transistor 236 are controlled to be in a non-conductive state is referred to as controlling of the transfer gate 234 to be in the OFF state.

Next, contents of decoding of the decoder 216 will be described with reference to FIG. 10. FIG. 10 is a diagram illustrating the contents of decoding in the decoder 216.

The two-bit print data [SIH, SIL], the two-bit operation mode data [MCH, MCL], the latch signal LAT, and the change signal CH are input to the decoder 216.

In a case of the printing mode in which the operation mode data [MCH, MCL] is [1, 1], the decoder 216 outputs the selection signal S having a logical level based on the print data [SIH, SIL], in each of the periods T1, T2, and T3 defined by the latch signal LAT and the change signal CH.

Specifically, in a case where the print data [SIH, SIL] is [1, 1] for defining "a large dot" in the printing mode, the decoder 216 outputs the selection signal S which has an H level in the period T1, an H level in the period T2, and an L level in the period T3.

In a case where the print data [SIH, SIL] is [1, 0] for defining "a medium dot" in the printing mode, the decoder 216 outputs the selection signal S which has an H level in the period T1, an L level in the period T2, and an L level in the period T3.

In a case where the print data [SIH, SIL] is [0, 1] for defining "a small dot" in the printing mode, the decoder 216 outputs the selection signal S which has an L level in the period T1, an H level in the period T2, and an L level in the period T3.

In a case where the print data [SIH, SIL] is [0, 0] for defining "fine vibration" in the printing mode, the decoder 216 outputs the selection signal S which has an L level in the period T1, an L level in the period T2, and an H level in the period T3.

The decoder 216 determines the logical level of the selection signal S regardless of the print data [SIH, SIL] and the periods T1, T2, and T3, in the standby mode, the transfer mode, and the sleep mode.

Specifically, in a case of the standby mode in which the operation mode data [MCH, MCL] is [1, 0], the decoder 216 outputs the selection signal S having an H level.

In a case of the transfer mode in which the operation mode data [MCH, MCL] is [0, 0], the decoder 216 outputs the selection signal S having an L level.

In a case of the sleep mode in which the operation mode data [MCH, MCL] is [0, 1], the decoder 216 outputs the selection signal S having an L level.

Here, the logical level of the selection signal S is shifted to a high amplitude logic based on the voltage VHV-TG, by a level shifter (not illustrated).

An operation of generating the drive signal VOUT based on the drive signal COM and supplying the generated drive signal VOUT to the ejection unit 600 in the ejection module 21, in the above-described drive IC 80, will be described with reference to FIG. 11.

Figure 11:
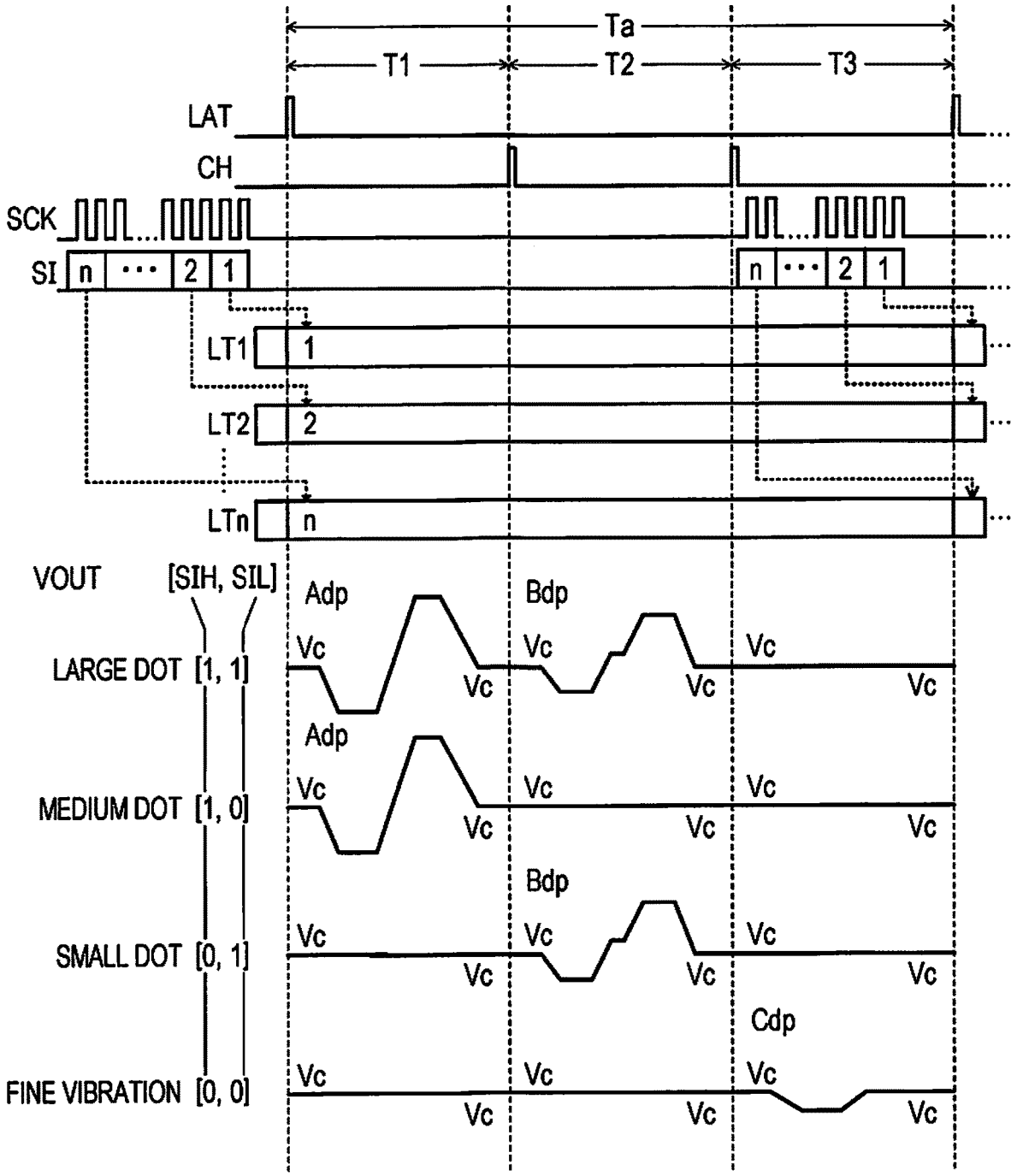
FIG. 11 is a diagram illustrating an operation of the drive IC in the printing mode.

FIG. 11 is a diagram illustrating an operation of the drive IC 80 in the printing mode.

In the printing mode, the print data signal SI is serially supplied in synchronization with the clock signal SCK and is sequentially transferred in the shift register 212 corresponding to the ejection unit 600. If a supply of the clock signal SCK stops, the print data [SIH, SIL] corresponding to the ejection unit 600 is held in each of the shift registers 212. The print data signal SI is supplied in order corresponding to the ejection units 600 of the final n-th stage, . . . , the second stage, and the first stage in the shift register 212.

Here, if the latch signal LAT rises, each of the latch circuits 214 latches the print data [SIH, SIL] held in the corresponding shift register 212. In FIG. 11, LT1, LT2, and LTn indicate the print data [SIH, SIL] latched by the latch circuits 214 corresponding to the shift registers 212 of the first stage, the second stage, . . . , and the n-th stage, respectively.

The decoder 216 outputs the selection signal S having a logical level depending on the contents illustrated in FIG. 10, in each of the periods T1, T2, and T3 in accordance with the size of a dot defined by the latched print data [SIH, SIL].

In a case where the print data [SIH, SIL] is [1, 1], the selection circuit 230 selects the voltage waveform Adp in the period T1, selects the voltage waveform Bdp in the period T2, and does not select the voltage waveform Cdp in the period T3, in accordance with the selection signal S. As a result, the drive signal VOUT corresponding to a large dot as illustrated in FIG. 11 is supplied to the ejection unit 600.

In a case where the print data [SIH, SIL] is [1, 0], the selection circuit 230 selects the voltage waveform Adp in the period T1, does not select the voltage waveform Bdp in the period T2, and does not select the voltage waveform Cdp in the period T3, in accordance with the selection signal S. As a result, the drive signal VOUT corresponding to a medium dot as illustrated in FIG. 11 is supplied to the ejection unit 600.

In a case where the print data [SIH, SIL] is [0, 1], the selection circuit 230 does not select the voltage waveform Adp in the period T1, selects the voltage waveform Bdp in the period T2, and does not select the voltage waveform Cdp in the period T3, in accordance with the selection signal S. As a result, the drive signal VOUT corresponding to a small dot as illustrated in FIG. 11 is supplied to the ejection unit 600.

In a case where the print data [SIH, SIL] is [0, 0], the selection circuit 230 does not select the voltage waveform Adp in the period T1, does not select the voltage waveform Bdp in the period T2, and selects the voltage waveform Cdp in the period T3, in accordance with the selection signal S. As a result, the drive signal VOUT corresponding to fine vibration as illustrated in FIG. 11 is supplied to the ejection unit 600.

Printing is not performed in the standby mode, the transfer mode, and the sleep mode. Therefore, in the embodiment, in the standby mode, the transfer mode, and the sleep mode, the clock signal SCK and the print data signal SI have an L level in addition to the latch signal LAT and the change signal CH described above. Thus, the shift register 212 and the latch circuit 214 do not operate. Therefore, as described above, in the standby mode, the transfer mode, and the sleep mode, the decoder 216 determines the logical level of the selection signal S in accordance with the operation mode signal MC.

In a case of the standby mode in which the operation mode data [MCH, MCL] is [1, 0], the selection circuit 230 selects the drive signal COM having a voltage value which is equal to that of the criterion voltage signal VBS, in accordance with the supplied selection signal S having an H level. Then, the selection circuit 230 supplies the selected drive signal COM to the ejection unit 600 as the drive signal VOUT.

In a case of the standby mode in which the operation mode data [MCH, MCL] is [1, 0], the selection circuit 230 selects the drive signal COM having a voltage value equal to that of the criterion voltage signal VBS, in accordance with the supplied selection signal S having an H level. As a result, the drive signal VOUT having a voltage value equal to that of the criterion voltage signal VBS is supplied to the ejection unit 600.

In a case of the transfer mode in which the operation mode data [MCH, MCL] is [0, 0], the selection circuit 230 causes the transfer gate 234 to turn into the OFF state, in accordance with the supplied selection signal S having an L level. As a result, the drive signal COM is not supplied to the ejection unit 600 as the drive signal VOUT.

In a case of the sleep mode in which the operation mode data [MCH, MCL] is [0, 1], the selection circuit 230 does not select the drive signal COM as the drive signal VOUT, in accordance with the supplied selection signal S having an L level. As a result, the voltage supplied just before is held in the piezoelectric element 60.

5. Configuration and Operation of Ejection Unit

Figure 12:
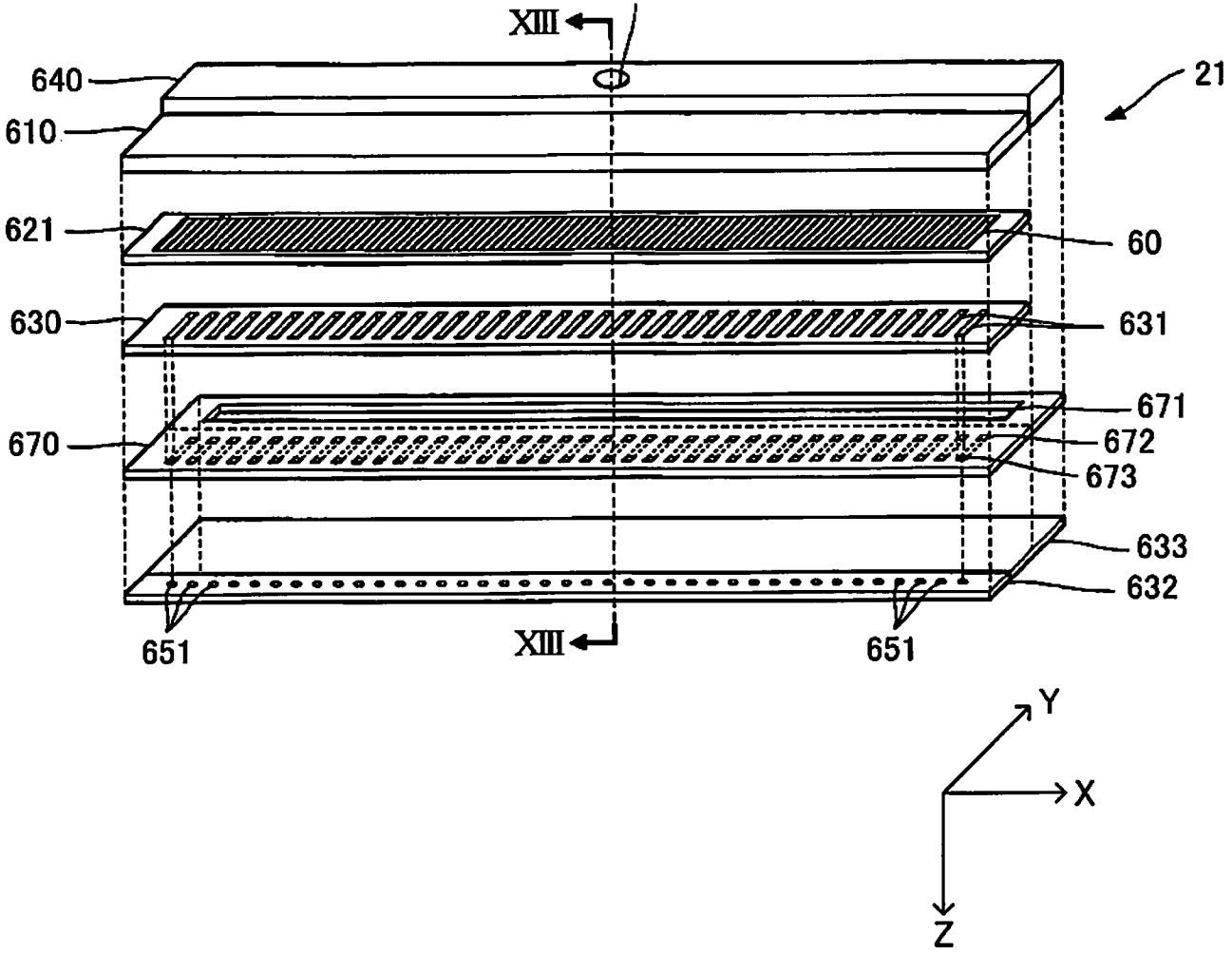
FIG. 12 is an exploded perspective view of the ejection module.
Figure 13:
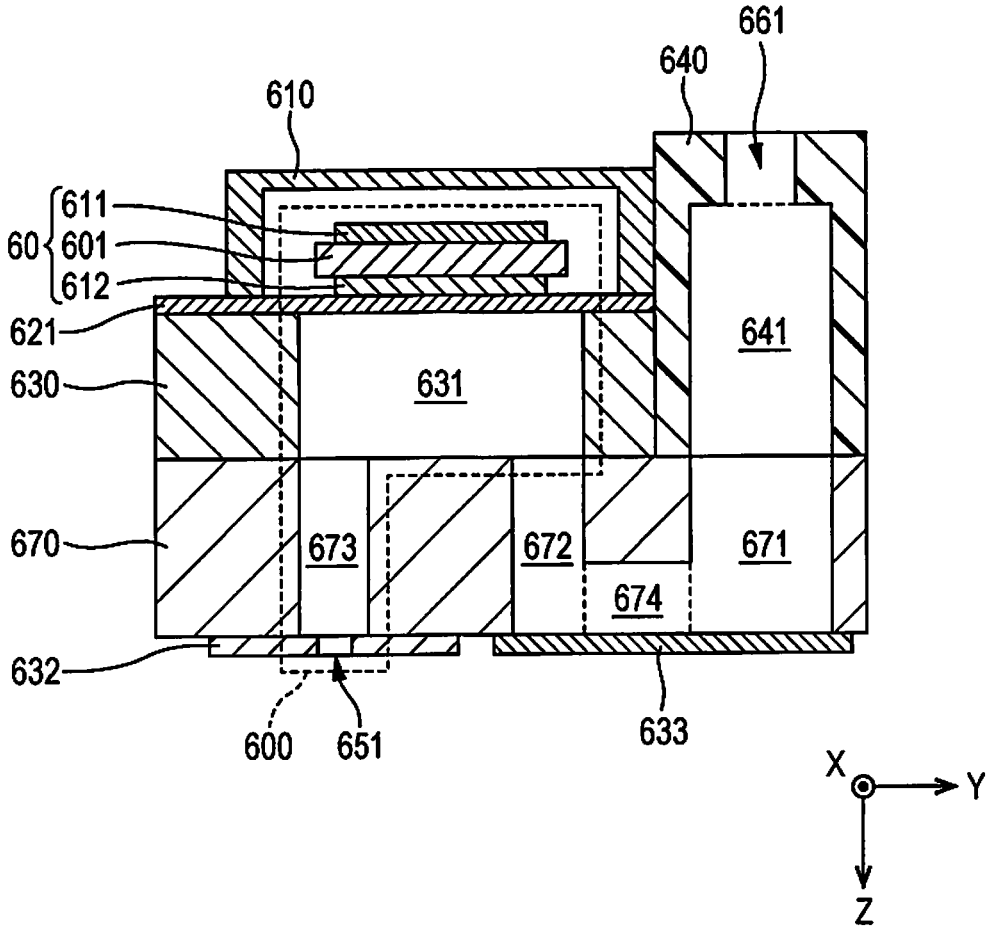
FIG. 13 is a sectional view illustrating an overall configuration of an ejection unit.

Next, a configuration and an operation of the ejection module 21 and the ejection unit 600 will be described. FIG. 12 is an exploded perspective view of the ejection module 21. FIG. 13 is a sectional view taken along line XIII-XIII in FIG. 12 and is a sectional view illustrating an overall configuration of the ejection unit 600.

As illustrated in FIGS. 12 and 13, the ejection module 21 includes a flow path substrate 670 having a substantially rectangular shape which is long in the direction X. A pressure chamber substrate 630, a vibration plate 621, a plurality of piezoelectric elements 60, a casing member 640, and a sealing member 610 are provided on one surface side of the flow path substrate 670 in the direction Z. A nozzle plate 632 and a vibration absorption member 633 are provided on another surface side of the flow path substrate 670 in the direction Z. Such components of the ejection module 21 are members having a substantially rectangular shape which is long in the direction X, similar to the flow path substrate 670. The components of the ejection module 21 are bonded to each other by using an adhesive or the like.

As illustrated in FIG. 12, the nozzle plate 632 is a plate-shape member in which a plurality of nozzles 651 arranged in the direction X is formed. Such a nozzle 651 is an aperture portion which is provided in the nozzle plate 632 and communicates with a cavity 631 which will be described later.

The flow path substrate 670 is a plate-shape member for forming a flow path of an ink. As illustrated in FIGS. 12 and 13, an opening portion 671, a supply flow path 672, and a communicating flow path 673 are formed in the flow path substrate 670. The opening portion 671 is a through-hole which penetrates in the direction Z, is formed commonly in the plurality of nozzles 651, and is long in the direction X. The supply flow path 672 and the communicating flow path 673 are through-holes formed to correspond to each of the plurality of nozzles 651. As illustrated in FIG. 13, a relay flow path 674 which is formed commonly in a plurality of supply flow paths 672 is provided on one surface of the flow path substrate 670 in the direction Z. The relay flow path 674 communicates with the opening portion 671 and the plurality of supply flow paths 672.

The casing member 640 is a structural body manufactured by injection molding with a resin material, for example. The casing member is fixed to another surface of the flow path substrate 670 in the direction Z. As illustrated in FIG. 13, a supply flow path 641 and a supply port 661 are formed in the casing member 640. The supply flow path 641 is a recess portion corresponding to the opening portion 671 of the flow path substrate 670. The supply port 661 is a through-hole communicating with the supply flow path 641. As described above, a space in which the opening portion 671 of the flow path substrate 670 and the supply flow path 641 of the casing member 640 communicate with each other functions as a reservoir that stores an ink supplied from the supply port 661.

The vibration absorption member 633 is a component to absorb pressure fluctuation occurring in the reservoir. Specifically, the vibration absorption member 633 is fixed to one surface side of the flow path substrate 670 in the direction Z such that the opening portion 671, the relay flow path 674, and the plurality of supply flow paths 672 which have been formed in the flow path substrate 670 are closed, and thereby constitute the bottom surface of the reservoir. Such a vibration absorption member 633 includes, for example, a compliance substrate which is a flexible sheet member capable of elastically deforming.

As illustrated in FIGS. 12 and 13, the pressure chamber substrate 630 is a plate-shape member in which a plurality of cavities 631 corresponding to the plurality of nozzles 651 is formed. The plurality of cavities 631 has a long shape in the direction Y and is provided to be arranged in the direction X. One end portion of the cavity 631 in the direction Y communicates with the supply flow path 672, and the other end portion of the cavity 631 in the direction Y communicates with the communicating flow path 673.

As illustrated in FIGS. 12 and 13, the vibration plate 621 is fixed to a surface of the pressure chamber substrate 630 on an opposite side of the surface thereof which is connected to the flow path substrate 670. The vibration plate 621 is a plate-shape member capable of elastically deforming. Specifically, as illustrated in FIG. 13, the flow path substrate 670 and the vibration plate 621 face each other to be spaced from each other in each of the cavities 631. That is, the vibration plate 621 constitutes an upper surface of the cavity 631, which is a portion of a wall surface of the cavity 631.

The cavity 631 is located between the flow path substrate 670 and the vibration plate 621 and functions as a pressure chamber in which pressure is applied to an ink with which the cavity 631 is filled.

As illustrated in FIGS. 12 and 13, the plurality of piezoelectric elements 60 is provided on a surface of the vibration plate 621 on an opposite side of the cavity 631. In other words, the vibration plate 621 is provided between the cavity 631 and the piezoelectric element 60. The plurality of piezoelectric elements 60 is provided to be arranged in the direction X with corresponding to the plurality of cavities 631. The vibration plate 621 vibrates with the piezoelectric element 60 deforming. Thus, pressure in the cavity 631 fluctuates, and an ink is ejected from the nozzle 651. Specifically, the piezoelectric element 60 is an actuator which deforms by supplying the drive signal VOUT. As illustrated in FIG. 13, the piezoelectric element 60 has a structure in which a piezoelectric body 601 is interposed between a pair of electrodes 611 and 612. The drive signal VOUT is supplied to the electrode 611. The criterion voltage signal VBS is supplied to the electrode 612. In this case, in the piezoelectric element 60, the center portion of the piezoelectric body 601 vertically deforms with respect to both end portions, along with the vibration plate 621 in accordance with a potential difference between the electrode 611 and the electrode 612. An ink is ejected from the nozzle 651 by the piezoelectric element 60 deforming. Here, the vibration plate 621 functions as a diaphragm that performs displacement by the piezoelectric element 60, and expands or reduces an internal volume of the cavity 631 filled with the ink. The electrode 611 in the piezoelectric element 60 is an example of a first electrode. The electrode 612 is an example of a second electrode.

The sealing member 610 in FIGS. 12 and 13 is a structural body that protects the plurality of piezoelectric elements 60 and reinforces the mechanical strength of the pressure chamber substrate 630 and the vibration plate 621. The sealing member 610 is fixed to the vibration plate 621 by an adhesive, for example. The plurality of piezoelectric elements 60 is accommodated in a recess portion of the sealing member 610, which is formed on a surface thereof facing the vibration plate 621.

In the ejection module 21 constituted in the above-described manner, a configuration including the piezoelectric element 60, the cavity 631, the vibration plate 621, and the nozzle 651 corresponds to the ejection unit 600.

Figure 14:
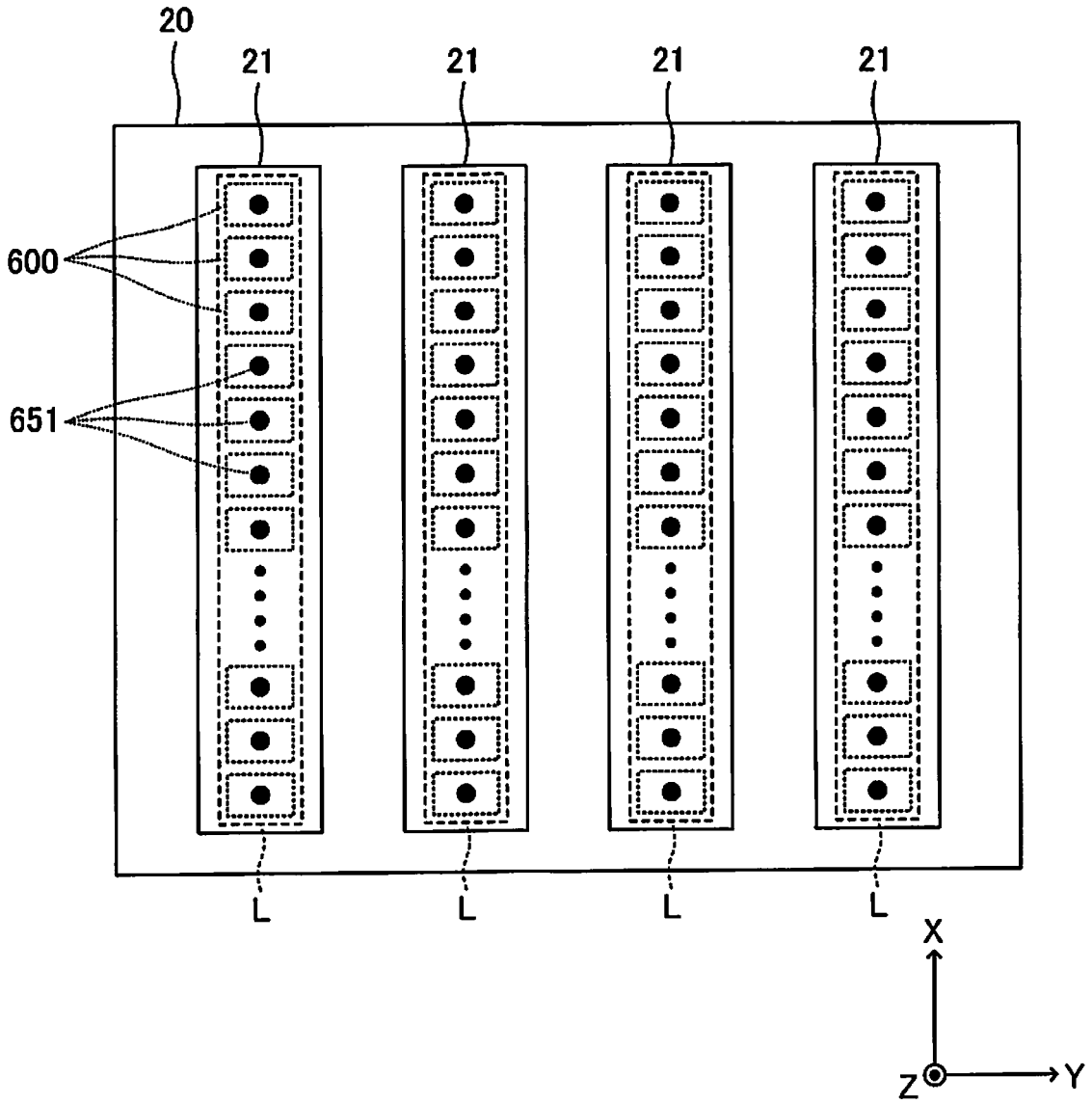
FIG. 14 is a diagram illustrating an example of the ejection module and an arrangement of a plurality of nozzles provided in the ejection module.

FIG. 14 is a diagram illustrating an example of the ejection module 21 and an arrangement of the plurality of nozzles 651 provided in the ejection module 21, in a case where the liquid ejecting apparatus 1 is viewed in the direction Z in a plan view. In FIG. 14, descriptions will be made on the assumption that the head unit 20 includes four ejection modules 21.

As illustrated in FIG. 14, a nozzle row L including a plurality of nozzles 651 provided in a row in a predetermined direction is formed in each of the ejection modules 21. Each nozzle row L is formed by n nozzles 651 arranged in a row in the direction X.

The nozzle row L illustrated in FIG. 14 is just an example and may have a different configuration. For example, in each nozzle row L, n nozzles 651 may be arranged in a staggered manner such that positions of the even-numbered nozzles 651 are different from positions of the odd-numbered nozzles 651 in the direction Y, when counting from the end. Each nozzle row L may be formed in a direction different from the direction X. In the embodiment, the row number of the nozzle rows L provided in each ejection module 21 is set to "1" as an example. However, "2" or more nozzle rows L may be formed in each ejection module 21.

Here, in the embodiment, the n nozzles 651 for forming the nozzle row L are provided at high density, that is, 300 pieces or more per 1 inch in the ejection module 21. Therefore, in the ejection module 21, n piezoelectric elements 60 are provided at high density so as to correspond to the n nozzles 651.

In the embodiment, the piezoelectric body 601 used in the piezoelectric element 60 is preferably a thin film having a thickness which is equal to or smaller than 1 μm, for example. Thus, it is possible to increase an amount of displacement of the piezoelectric element 60 with respect to the potential difference between the electrode 611 and the electrode 612.

Figure 15:
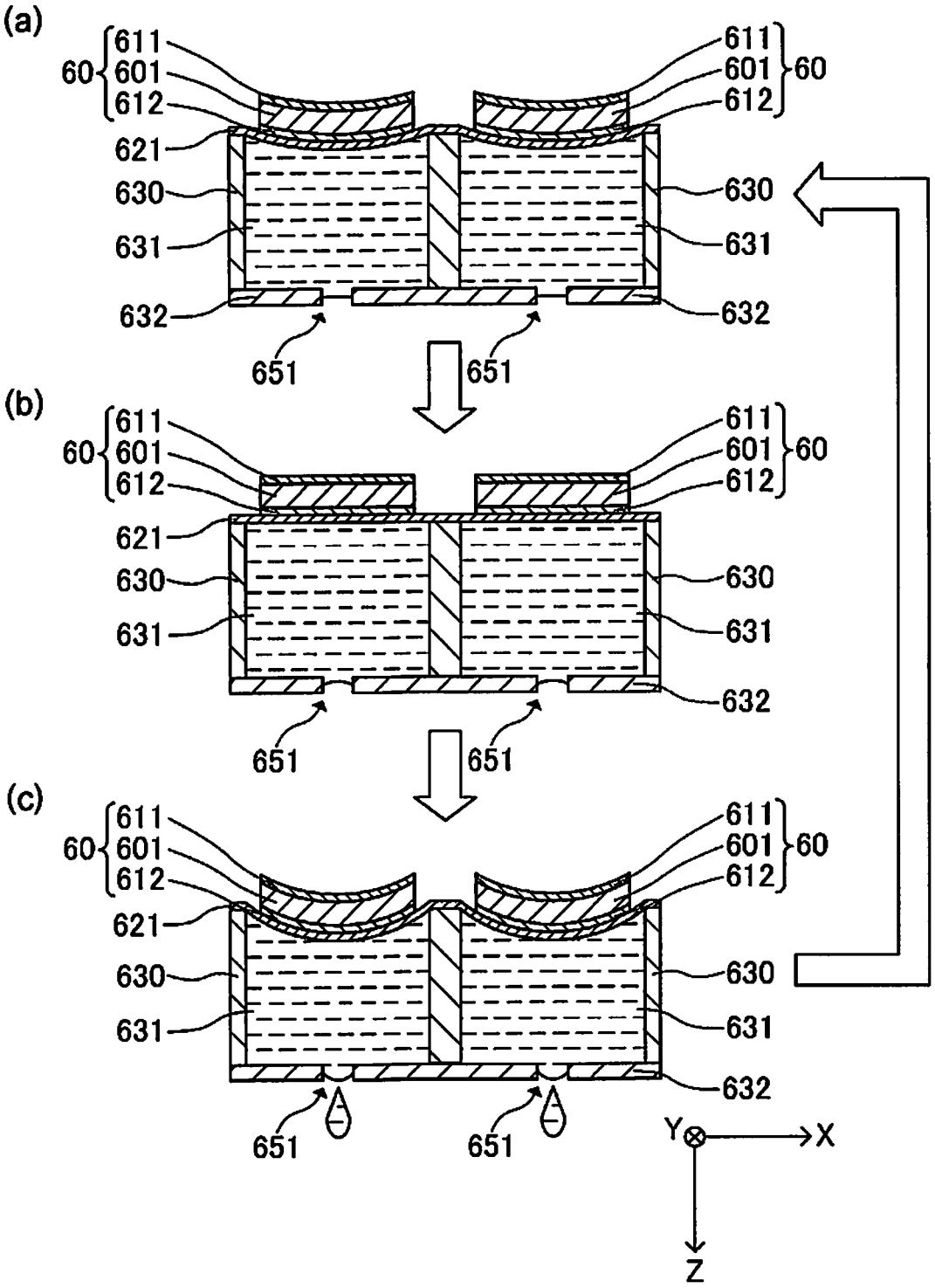
FIG. 15 is a diagram illustrating a relationship between displacement of a piezoelectric element and a vibration plate and an ejection.

Here, an ejection operation of an ink ejected from the nozzle 651 will be described with reference to FIG. 15. FIG. 15 is a diagram illustrating a relationship between displacement of the piezoelectric element 60 and the vibration plate 621 and an ejection, in a case where the drive signal VOUT is supplied to the piezoelectric element 60. FIG. 15 is a sectional view in a case where the plurality of piezoelectric elements 60, the cavity 631, and two nozzles 651 in the ejection module 21 are viewed from the direction Y. (a) of FIG. 15 schematically illustrates the displacement of the piezoelectric element 60 and the vibration plate 621 in a case where the voltage Vc as the drive signal VOUT is supplied. (b) of FIG. 15 schematically illustrates the displacement of the piezoelectric element 60 and the vibration plate 621 in a case where the voltage value of the drive signal VOUT supplied to the piezoelectric element 60 is controlled to approach the criterion voltage signal VBS from the voltage Vc. (c) of FIG. 15 schematically illustrates the displacement of the piezoelectric element 60 and the vibration plate 621 in a case where the voltage value of the drive signal VOUT supplied to the piezoelectric element 60 is controlled to be separated from the criterion voltage signal VBS farther than the voltage Vc.

In a state illustrated in (a) of FIG. 15, the piezoelectric element 60 and the vibration plate 621 bend in the direction Z in accordance with a potential difference between the drive signal VOUT supplied to the electrode 611 and the criterion voltage signal VBS supplied to the electrode 612. At this time, the voltage Vc is supplied to the electrode 611 as the drive signal VOUT. As described above, the voltage Vc corresponds to a voltage value at the start timings and the end timings of the voltage waveforms Adp, Bdp, and Cdp. That is, the state of the piezoelectric element 60 and the vibration plate 621, which is illustrated in (a) of FIG. 15 serves as a criterion state of the piezoelectric element 60 in the printing mode.

In a case where the voltage value of the drive signal VOUT is controlled to approach the voltage value of the criterion voltage signal VBS, as illustrated in (b) of FIG. 15, the amount of displacement of the piezoelectric element 60 and the vibration plate 621 in the direction Z is reduced. At this time, the internal volume of the cavity 631 expands, and thereby the ink is supplied from the reservoir into the cavity 631.

Then, the voltage value of the drive signal VOUT is controlled to be separated from the voltage value of the criterion voltage signal VBS. At this time, as illustrated in (c) of FIG. 15, the amount of displacement of the piezoelectric element 60 and the vibration plate 621 in the direction Z increases. At this time, the internal volume of the cavity 631 is reduced, and thus the ink with which the cavity 631 is filled is ejected from the nozzle 651.

In the embodiment, the states of (a) to (c) of FIG. 15 are repeated by supplying the drive signal VOUT to the piezoelectric element 60. Thus, the ink is ejected from the nozzle 651, and a dot is formed on the medium P. The amount of displacement of the piezoelectric element 60 and the vibration plate 621 illustrated in (a) to (c) of FIG. 15 increases in the direction Z, as the potential difference between the drive signal VOUT supplied to the electrode 611 and the criterion voltage signal VBS supplied to the electrode 612 increases. In other words, the amount of the ink ejected from the nozzle 651 is controlled in accordance with the potential difference between the drive signal VOUT and the criterion voltage signal VBS.

The displacement of the piezoelectric element 60 and the vibration plate 621 with respect to the drive signal VOUT as illustrated in FIG. 15 is just an example. For example, in a case where the potential difference between the drive signal VOUT and the criterion voltage signal VBS is large, the ink may be attracted into the cavity 631. In addition, in a case where the potential difference between the drive signal VOUT and the criterion voltage signal VBS is small, the ink with which the cavity 631 is filled may be ejected from the nozzle 651.

6. Details of Transfer Mode and Discharge of Piezoelectric Element

As described above, in the sleep mode, the transfer gate 234 in the selection circuit 230 is controlled to be in the OFF state. Ideally, a voltage and a current which are supplied to the electrode 611 in the sleep mode are cut off by the transfer gate 234. Thus, a voltage just before the transfer gate 234 is controlled to be in the OFF state is held in the electrode 611. Thus, if the voltage supplied to the electrode 611 just before the transfer gate 234 is controlled to be in the OFF state is set to be approximate to the voltage of the criterion voltage signal VBS supplied to the electrode 612, it is possible to reduce an occurrence of displacement of the piezoelectric element 60 in the sleep mode.

However, the transfer gate 234 and the piezoelectric element 60 have a resistance component. Therefore, even in a case where the transfer gate 234 is controlled to be in the OFF state, a leakage current is supplied to the electrode 611 via the resistance components of the transfer gate 234 and the piezoelectric element 60. Therefore, charges are accumulated in the electrode 611 by the leakage current. Thus, the voltage value of the electrode 611 may increase, and the piezoelectric element 60 may perform not-intended displacement.

Figure 16:
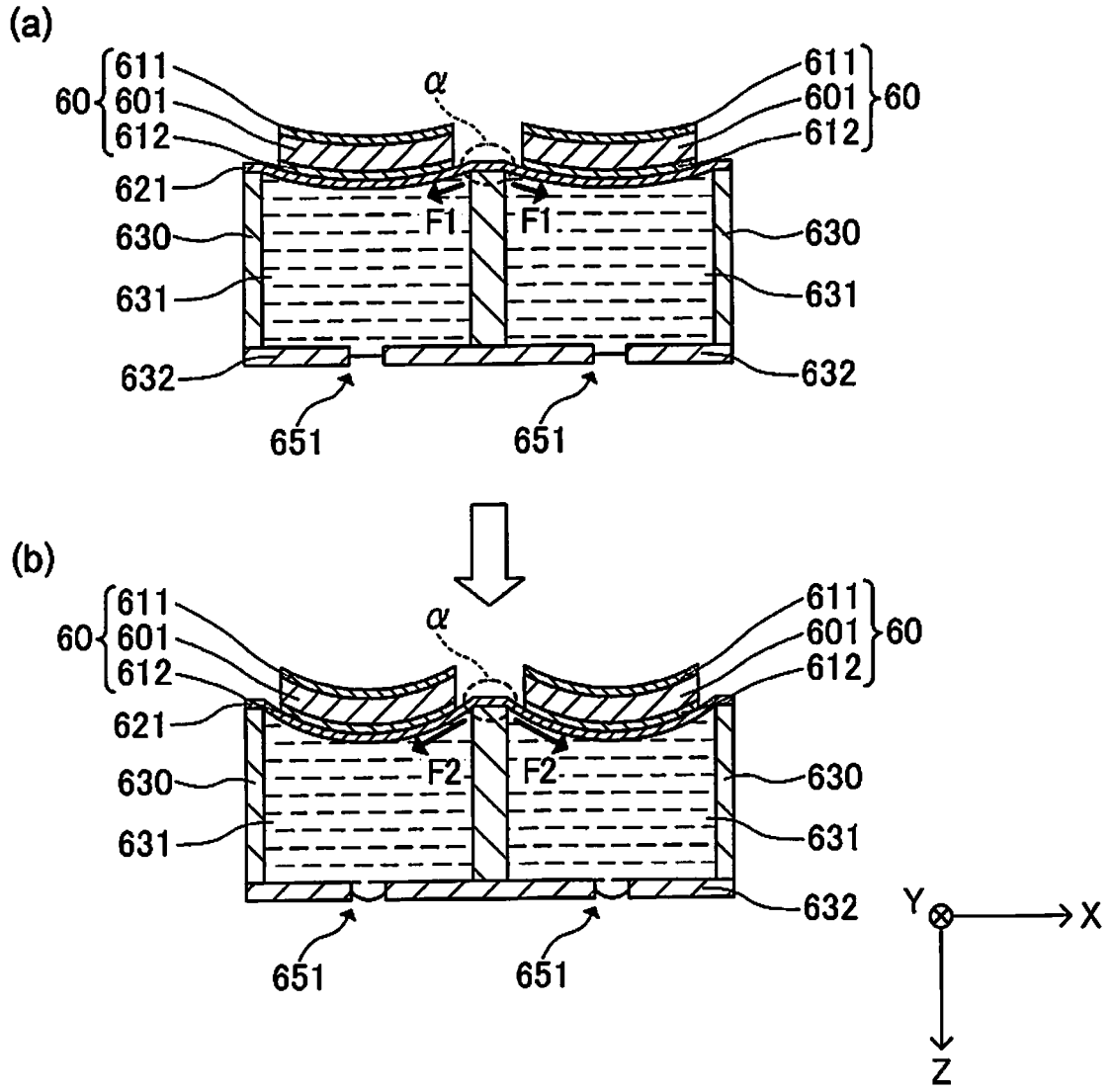
FIG. 16 is a diagram schematically illustrating the displacement of the piezoelectric element and the vibration plate in a case where a voltage value of an electrode in the piezoelectric element increases.

FIG. 16 is a diagram schematically illustrating the displacement of the piezoelectric element 60 and the vibration plate 621 in a case where the voltage value of the electrode 611 increases by the leakage current. FIG. 16 is a sectional view in a case where the plurality of piezoelectric elements 60, the cavity 631, and two nozzles 651 in the ejection module 21 are viewed from the direction Y. (a) of FIG. 16 illustrates the displacement of the piezoelectric element 60 and the vibration plate 621 just after the mode has transitioned to the sleep mode. (b) of FIG. 16 illustrates the displacement of the piezoelectric element 60 and the vibration plate 621 in a case where charges are accumulated in the electrode 611 by the leakage current generated in the transfer gate 234 and the piezoelectric element 60.

As illustrated in (a) of FIG. 16, the piezoelectric element 60 just after the mode has transitioned to the sleep mode performs displacement based on the potential difference between the voltage of the electrode 611 and the voltage of the electrode 612. At this time, the voltage just before the mode has transitioned to the sleep mode is held in the electrode 611. That is, the voltage of the electrode 611 just after the mode has transitioned to the sleep mode is a voltage assumed to be held in the electrode 611. Thus, the piezoelectric element 60 performs displacement in an assumed range. Similarly, the vibration plate 621 performs displacement in an assumed range. At this time, stress F1 in an assumed range occurs at a contact point α between the vibration plate 621 and the cavity 631.

(a) of FIG. 16 illustrates a case where the voltage of the electrode 611 is different from the voltage of the electrode 612 just before the mode has transitioned to the sleep mode, as an example. However, preferably, the voltage of the electrode 611 and the voltage of the electrode 612 have voltage values equal to each other. In this case, the piezoelectric element 60 and the vibration plate 621 do not perform displacement.

In a case where charges are accumulated in the electrode 611 by the leakage current, the potential difference between the voltage of the electrode 611 and the voltage of the electrode 612 increases. As illustrated in (b) of FIG. 16, the piezoelectric element 60 performs larger displacement. Thus, the vibration plate 621 performs larger displacement. At this time, stress F2 larger than assumed may occur at the contact point α between the vibration plate 621 and the cavity 631.

Stress occurring at the contact point between the vibration plate 621 and the cavity 631 may vary depending on the position of the contact point between the vibration plate 621 and the cavity 631 in the direction Y.

Specifically, regarding the stress occurring at the contact point between the vibration plate 621 and the cavity 631, larger stress occurs at a point which is the contact point between the vibration plate 621 and the cavity 631 and at which the vibration plate 621 performs the maximum displacement in the direction Z.

Figure 17:
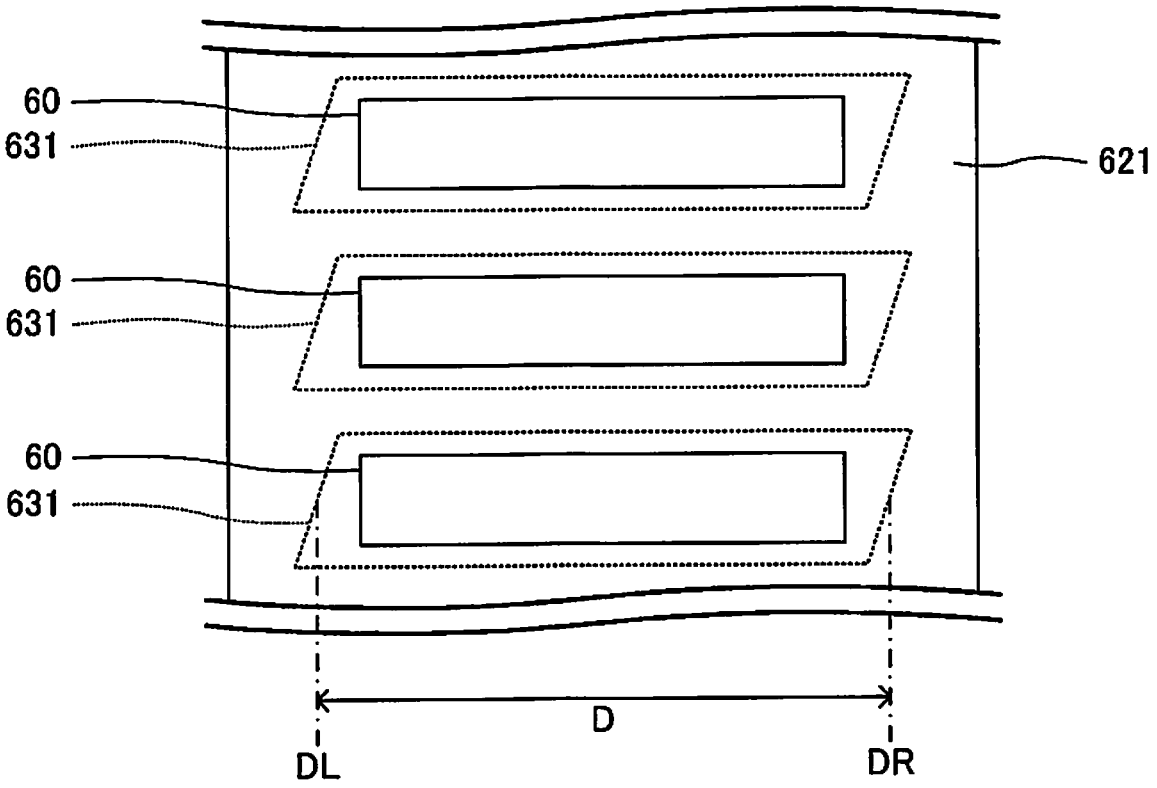
FIG. 17 is a plan view in a case where the vibration plate is viewed from a direction Z.

Examples of a factor of such displacement of the vibration plate 621 include a natural vibration occurring in the vibration plate 621. FIG. 17 is a plan view in a case where the vibration plate 621 is viewed from the direction Z. As illustrated in FIG. 17, the cavity 631 in the embodiment is long in the direction Y, and thus a natural vibration along the direction Y may occur in the vibration plate 621. Such a natural vibration occurs in a vibration region D between a first contact point DL and a second contact point DR at which the vibration plate 621 and the cavity 631 are in contact with each other.

Figure 18:
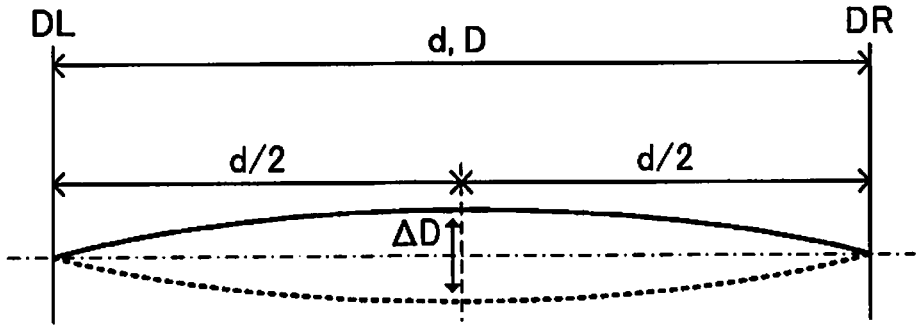
FIG. 18 is a diagram illustrating a case where the vibration plate performs a primary natural vibration.

FIG. 18 is a diagram illustrating a case where a primary natural vibration occurs in the vibration plate 621, as an example. As illustrated in FIG. 18, in a case where the primary natural vibration occurs in the vibration plate 621, displacement ΔD of the vibration plate 621, which is caused by the natural vibration becomes the maximum at the center portion of the vibration region D. Specifically, in a case where a distance from the first contact point DL to the second contact point DR in the vibration region D is set as d, the displacement ΔD of the vibration plate 621 becomes the maximum at a point at which a distance from the first contact point DL is d/2, and a distance from the second contact point DR is d/2.

Figure 19:
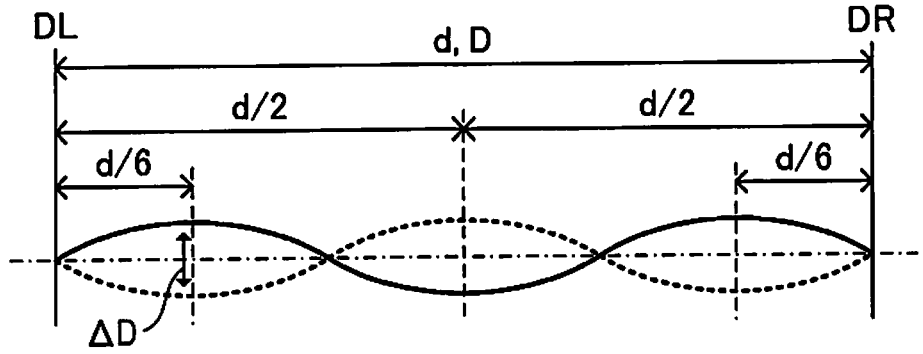
FIG. 19 is a diagram illustrating a case where the vibration plate performs a tertiary natural vibration.

FIG. 19 is a diagram illustrating a case where a tertiary natural vibration occurs in the vibration plate 621, as an example. As illustrated in FIG. 19, in a case where a tertiary natural vibration occurs in the vibration plate 621, the displacement ΔD of the vibration plate 621, which is caused by the natural vibration becomes the maximum at a point at which the distance from the first contact point DL is d/2, and the distance from the second contact point DR is d/2 and at a point at which the distance from the first contact point DL is d/6, and a distance from the second contact point DR is d/6.

As described above, larger stress F2 may be applied to the contact point α between the vibration plate 621 and the cavity 631 among the points at which the displacement ΔD of the vibration plate 621 is the maximum, in the direction Y.

In the operation mode such as the sleep mode, which continues for a long period, stress F2 may be continuously applied to the contact point α of the vibration plate 621 for a long period. As a result, cracks may occur in the vibration plate 621. In a case where the mode has transitioned to the printing mode in a state where the vibration plate 621 has performed displacement larger than assumed, a load larger than necessary may be applied to the vibration plate 621 by the displacement of the piezoelectric element 60 when an ink is ejected. As a result, cracks may occur in the vibration plate 621.

If the cracks occur in the vibration plate 621, the ink with which the cavity 631 is filled is leaked from the cracks. Therefore, the amount of the ejected ink with respect to the change of the internal volume of the cavity 631 may vary. As a result, ejection accuracy of the ink is deteriorated.

In a case where the ink leaked from the cracks has adhered to both the electrodes 611 and 612, a current path via the ink is formed between the electrode 611 and the electrode 612. Thus, the voltage value of the criterion voltage signal VBS supplied to the electrode 612 may fluctuate. In the liquid ejecting apparatus 1 according to the embodiment, the criterion voltage signal VBS is commonly supplied to a plurality of electrodes 612. Therefore, in a case where the voltage value of the criterion voltage signal VBS fluctuates, the fluctuation thereof influences displacement of the plurality of piezoelectric elements 60. As a result, the fluctuation thereof may influence the ejection accuracy of the entirety of the liquid ejecting apparatus 1.

Thus, in the embodiment, three discharge units that release charges in the electrodes 611 and 612 are provided in order to reduce an occurrence of a situation in which a not-intended potential difference occurs between the electrodes 611 and 612 in the piezoelectric element 60, and thereby the piezoelectric element 60 and the vibration plate 621 continuously perform not-intended displacement for a long period.

Figure 20:
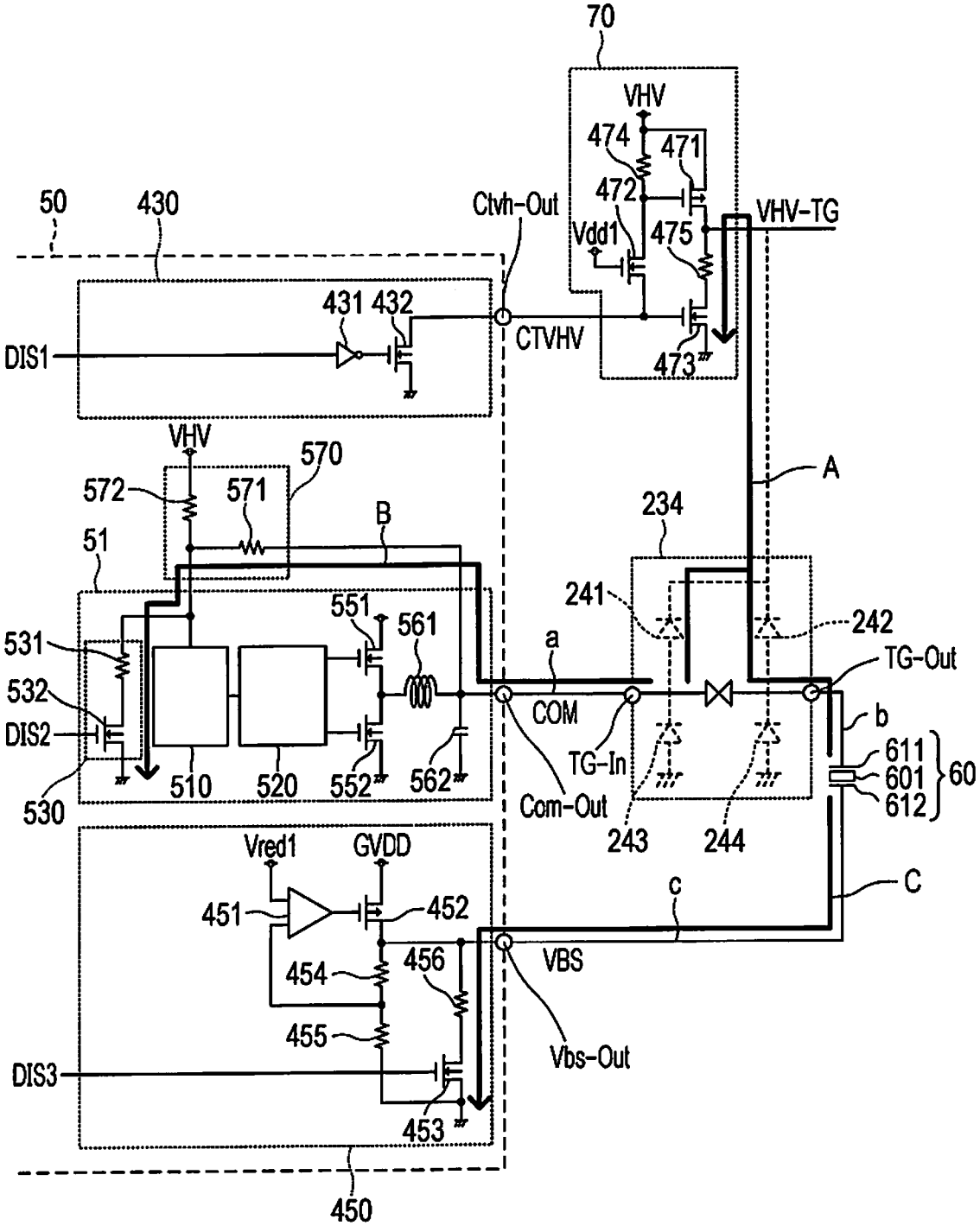
FIG. 20 is a diagram illustrating a discharge unit that releases charges in the piezoelectric element.

FIG. 20 is a diagram illustrating the discharge unit that releases charges in the piezoelectric element 60. In FIG. 20, parasitic diodes 241, 242, 243, and 244 formed in the transfer gate 234 are indicated by broken lines.

The first discharge unit releases charges via a first discharge path A illustrated in FIG. 20. Specifically, the first discharge unit releases charges accumulated between the terminal TG-Out and the electrode 611 via a plurality of parasitic diodes formed in the transfer gate 234 and releases charges accumulated between the terminal Com-Out and the terminal TG-In. A mode in which the first discharge unit performs an operation is an example of a first mode.

Here, details of the parasitic diodes 241, 242, 243, and 244 formed in the transfer gate 234 will be specifically described with reference to FIG. 21.

Figure 21:
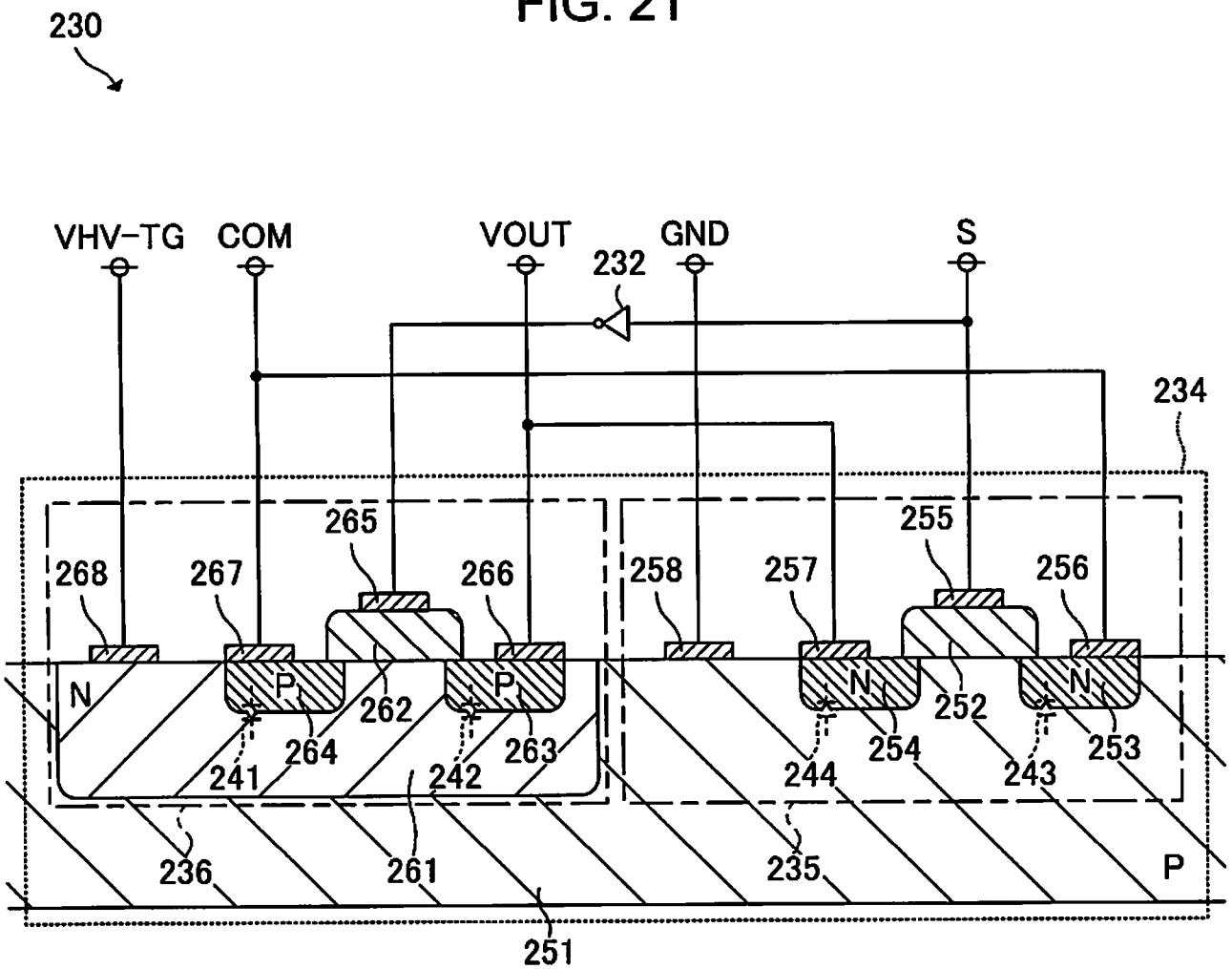
FIG. 21 is a sectional view schematically illustrating a transistor constituting a transfer gate.

FIG. 21 is a sectional view schematically illustrating the transistors 235 and 236 constituting the transfer gate 234.

As illustrated in FIG. 21, the transistor 235 includes a polysilicon 252, N-type diffusion layers 253 and 254, and a plurality of electrodes.

The N-type diffusion layers 253 and 254 are provided on a P-type substrate 251 to be spaced from each other. The polysilicon 252 is provided between the N-type diffusion layer 253 and the N-type diffusion layer 254 with an insulating layer (not illustrated) interposed therebetween.

An electrode 255 is electrically connected to the polysilicon 252. An electrode 256 is electrically connected to the N-type diffusion layer 253. An electrode 257 is electrically connected to the N-type diffusion layer 254.

The electrode 255 functions as a gate terminal. Any one of the electrodes 256 and 257 functions as a drain terminal, and the other functions as a source terminal. In the embodiment, descriptions will be made on the assumption that the electrode 256 is set as the drain terminal, and the electrode 257 is set as the source terminal.

In the transistor 235 constituted in the above-described manner, a PN junction is formed on a contact surface between the P-type substrate 251 and the N-type diffusion layer 253 and a contact surface between the P-type substrate 251 and the N-type diffusion layer 254. Thus, the parasitic diode 243 and the parasitic diode 244 are formed in the transistor 235. In the parasitic diode 243, the P-type substrate 251 functions as an anode, and the N-type diffusion layer 253 functions as a cathode. In the parasitic diode 244, the P-type substrate 251 functions as an anode, and the N-type diffusion layer 254 functions as a cathode.

An electrode 258 is electrically connected to the P-type substrate 251. Here, since the transistor 235 is formed in the P-type substrate 251, the electrode 258 functions as a back gate terminal of the transistor 235. The ground potential is supplied to the electrode 258.

The transistor 236 includes an N-well 261, a polysilicon 262, P-type diffusion layers 263 and 264, and a plurality of electrodes.

The P-type diffusion layers 263 and 264 are provided on the N-well 261 formed in the P-type substrate 251 to be spaced from each other. The polysilicon 262 is provided between the P-type diffusion layer 263 and the P-type diffusion layer 264 with an insulating layer (not illustrated) interposed therebetween.

An electrode 265 is electrically connected to the polysilicon 262. An electrode 266 is electrically connected to the P-type diffusion layer 263. An electrode 267 is electrically connected to the P-type diffusion layer 264.

The electrode 265 functions as a gate terminal. Any one of the electrodes 266 and 267 functions as a drain terminal, and the other functions as a source terminal. In the embodiment, descriptions will be made on the assumption that the electrode 266 is set as the drain terminal, and the electrode 267 is set as the source terminal.

In the transistor 236 constituted in the above-described manner, a PN junction is formed on a contact surface between the N-well 261 and the P-type diffusion layer 263 and a contact surface between the N-well 261 and the P-type diffusion layer 264. Thus, the parasitic diode 242 and the parasitic diode 241 are formed in the transistor 236. In the parasitic diode 242, the P-type diffusion layer 263 functions as an anode, and the N-well 261 functions as a cathode. In the parasitic diode 241, the P-type diffusion layer 264 functions as an anode, and the N-well 261 functions as a cathode terminal.

Here, the N-well 261 is an example of an N-type semiconductor layer. The P-type diffusion layer 264 which is electrically connected to the electrode 267 as a source terminal is an example of a first P-type semiconductor layer. The P-type diffusion layer 263 which is electrically connected to the electrode 266 as a drain terminal is an example of a second P-type semiconductor layer.

An electrode 268 is electrically connected to the N-well 261. Since the transistor 236 is formed in the N-well 261, the electrode 268 functions as a back gate terminal of the transistor 236. That is, the electrode 268 as a back gate terminal is electrically connected to the N-well 261. The voltage VHV-TG is supplied to the electrode 268.

Returning to FIG. 20, the first discharge unit which includes the parasitic diodes 241, 242, 243, and 244 described above and passes in the first discharge path A will be described.

In the first discharge unit, firstly, the discharge control signal DIS1 having an H level is supplied to the power-supply control signal generation circuit 430.

The discharge control signal DIS1 supplied to the power-supply control signal generation circuit 430 is supplied to the transistor 432 via the inverter 431. Thus, the transistor 432 is controlled to be in the OFF state.

As described above, in a case where the transistor 432 is controlled to be in the OFF state, the transistor 473 of the power supply switching circuit 70 is controlled to be in the ON state. If the transistor 473 is controlled to be in the ONF state, the voltage VHV-TG has a ground potential supplied via the resistor 475. Thus, the electrode 268 of the transistor 236 constituting the transfer gate 234 has a ground potential. Accordingly, the potential at a node a at which the terminal COM-Out and the terminal TG-In are connected to each other becomes the ground potential via the parasitic diode 241. Similarly, the potential at a node b at which the terminal TG-Out and the electrode 611 are connected to each other becomes the ground potential via the parasitic diode 242.

In other words, charges accumulated in the node a are released via the parasitic diode 241, the resistor 475, and the transistor 473. Similarly, charges accumulated in the node b are released via the parasitic diode 242, the resistor 475, and the transistor 473.

As described above, in the first discharge unit, the power supply switching circuit 70 sets the potential of the voltage VHV-TG to be the ground potential based on the discharge control signal DIS1. In other words, the electrode 268 of the transistor 236 to which the voltage VHV-TG is supplied is electrically connected to the drain terminal of the transistor 473. The source terminal of the transistor 473 is electrically connected to the ground terminal. In a case where the transistor 473 is controlled to be in the OFF state, based on the discharge control signal DIS1, the power supply switching circuit 70 supplies the voltage VHV-TG to the electrode 268. In a case where the transistor 473 is controlled to be in the ON state, based on the discharge control signal DIS1, the power supply switching circuit 70 electrically connects the electrode 268 and the terminal Gnd-In to each other. Thus, the charges accumulated in the node a and the node b are released via the parasitic diodes 241 and 242. Accordingly, an occurrence of a situation in which not-intended charges are accumulated in the electrode 611 is reduced. Here, the transistor 473 is an example of a switch element. The drain terminal of the transistor 473 is an example of one end of the switch element. The source terminal thereof is an example of the other end of the switch element. The power supply switching circuit 70 which includes the transistor 473 and controls whether to supply the voltage VHV-TG to the electrode 268 of the transistor 236 or whether to electrically connect the electrode 268 to the terminal Gnd-In is an example of a fourth switching circuit.

The charges in the node a and the node b, which are released by the first discharge unit correspond to charges at the terminals TG-In and TG-Out of the transfer gate 234. Thus, the charges can be released by the first discharge unit regardless of that the transfer gate 234 is controlled to be in the ON state or the OFF state. Therefore, it is possible to further reduce a probability of not-intended charges being accumulated in the electrode 611.

The configuration of the power supply switching circuit 70 is not limited to the above-described configuration. Any configuration may be provided as the configuration of the power supply switching circuit so long as the potential of the electrode 268 in the transistor 236 can be switched to be the ground potential.

Next, the second discharge unit will be described. In the second discharge unit, charges accumulated in the node a are released via a second discharge path B including the LC discharge circuit 530.

In a case where charges are released by the second discharge unit, firstly, the discharge control signal DIS2 having an H level is supplied to the transistor 532 of the LC discharge circuit 530. Thus, the transistor 532 is controlled to be in the ON state. Accordingly, the potential at the node a becomes the ground potential via the resistors 571 and 531 and the transistor 532. In other words, the charges accumulated in the node a are released via the resistors 571 and 531 and the transistor 532. A mode in which the second discharge unit performs an operation is an example of a third mode.

In a case where an operation of the drive signal generation circuit 50 stops, the voltage VHV may be supplied to the node a via the resistors 572 and 571. In the second discharge unit, the charges in the node a are capable of being released. Thus, it is possible to reduce an occurrence of a situation in which charges are accumulated in the node a by the voltage VHV.

As described above, in the second discharge unit, the charges in the node a are can be released. Thus, it is possible to lower the potential of the node a. Thus, a leakage current occurring from the terminal TG-In of the transfer gate 234 into the terminal TG-Out is reduced. That is, it is possible to reduce an increase of the voltage at the node b, which is caused by the leakage current. Accordingly, it is possible to further reduce a probability of not-intended charges being accumulated in the electrode 611.

The LC discharge circuit 530 may have a configuration in which charges in the node a can be released. For example, the LC discharge circuit 530 may be provided at a connection point which is commonly connected to the source terminal of the transistor 551 and the drain terminal of the transistor 552.

Next, the third discharge unit will be described. In the third discharge unit, charges accumulated at a node c at which the electrode 612 and the terminal Vbs-Out are connected to each other are released via a third discharge path C including the transistor 453 of the criterion-voltage signal generation circuit 450.

In a case where charges are released by the third discharge unit, firstly, the discharge control signal DIS3 having an H level is supplied to the transistor 453 of the criterion-voltage signal generation circuit 450. Thus, the transistor 453 is controlled to be in the ON state. Accordingly, the potential at the node c becomes the ground potential supplied via the resistor 456 and the transistor 453. In other words, the charges accumulated in the node c are released via the resistor 456 and the transistor 453. A mode in which the third discharge unit performs such an operation is an example of a second mode.

As described above, the piezoelectric element 60 performs displacement by the potential difference between the voltage of the electrode 611 and the voltage of the electrode 612. Since the charges accumulated in the node c are released by the third discharge unit, it is possible to reduce an occurrence of a situation in which a not-intended voltage is supplied to the electrode 612. Thus, it is possible to further reduce the occurrence of a situation in which the piezoelectric element 60 performs not-intended displacement. Here, the node b illustrated in FIG. 20 corresponds to the above-described first node. The node c corresponds to the above-described second node. The node a is an example of a third node.

In the embodiment, charges are released by the first discharge unit, the second discharge unit, and the third discharge unit described above, in the transfer mode. A method of releasing charges by the first discharge unit, the second discharge unit, and the third discharge unit in the embodiment will be described with reference to FIG. 22.

Figure 22:
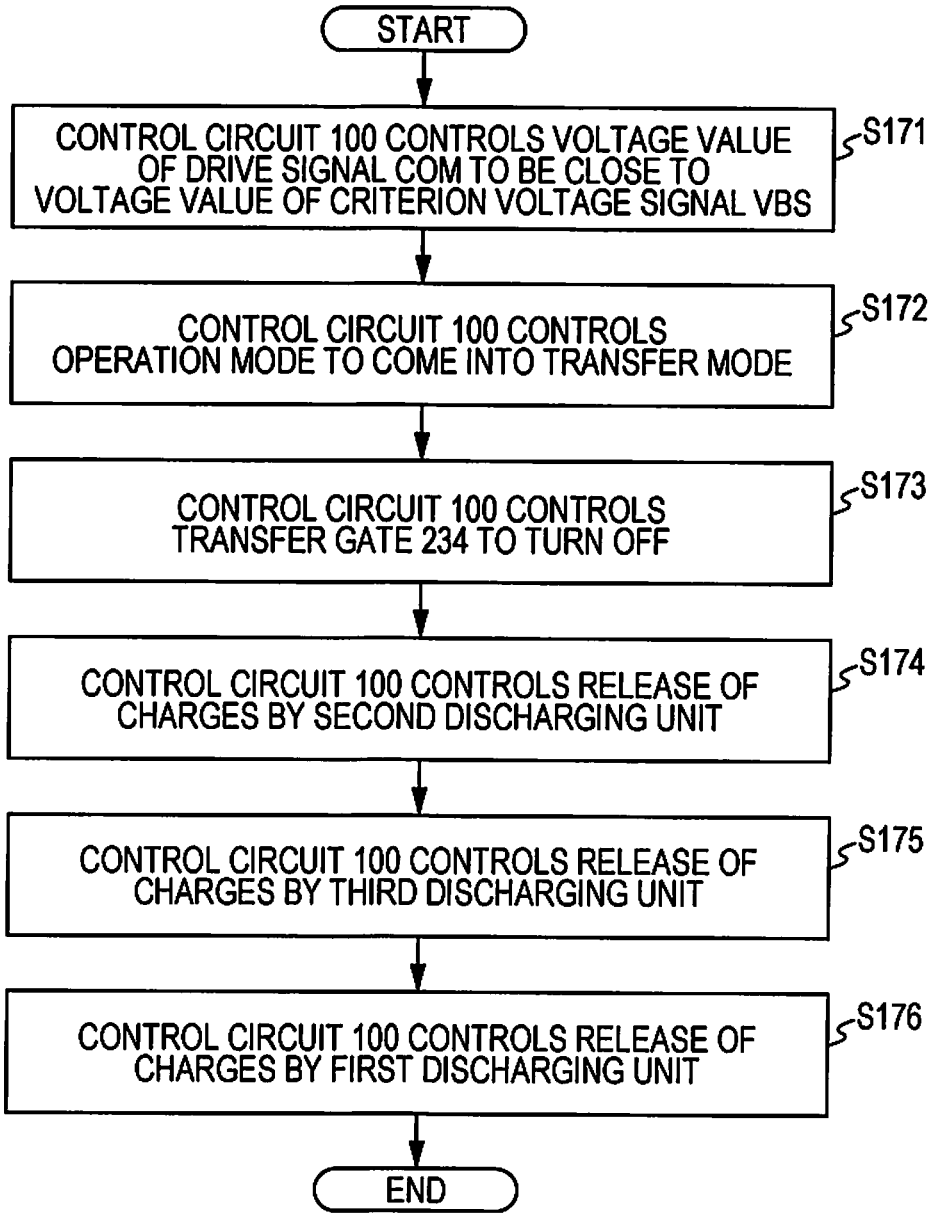
FIG. 22 is a flowchart illustrating an operation in a transfer mode.

FIG. 22 is a flowchart illustrating an operation in the transfer mode.

Firstly, before the operation mode transitions to the transfer mode, the control circuit 100 performs control such that the voltage value of the drive signal COM approaches the voltage value of the criterion voltage signal VBS (S171). Specifically, the control circuit 100 supplies the drive data signal DRV which causes the voltage value of the drive signal COM to be equal to the voltage value of the criterion voltage signal VBS, to the drive signal generation circuit 50. The drive signal generation circuit 50 performs control based on the supplied drive data signal DRV, such that the voltage value of the drive signal COM approaches the voltage value of the criterion voltage signal VBS.

In the transfer mode, both the voltage values of the drive signal COM and the criterion voltage signal VBS may fluctuate in the middle of the operation mode transitioning to the sleep mode. Therefore, before a transition to the transfer mode, the voltage value of the drive signal COM is controlled to approach the voltage value of the criterion voltage signal VBS. Thus, it is possible to reduce a probability of a not-intended potential difference occurring in the piezoelectric element 60 in the transfer mode.

The phrase that the voltage value of the drive signal COM is controlled to approach the voltage value of the criterion voltage signal VBS preferably means that the voltage value of the drive signal COM is equal to the voltage value of the criterion voltage signal VBS. In a broad sense, the voltage value of the drive signal COM may be controlled to approach the voltage value of the criterion voltage signal as close as the piezoelectric element 60 does not perform not-intended displacement occurring by the potential difference between the drive signal COM and the criterion voltage signal VBS. Specifically, it is preferable that the voltage value be controlled such that the potential difference between the drive signal COM and the criterion voltage signal VBS is set to be equal to or lower than 2 V.

In a case where the voltage value of the drive signal COM is sufficiently approximate to the voltage value of the criterion voltage signal VBS, the control circuit 100 controls the operation mode to come into the transfer mode (S172).

After the operation mode transitions to the transfer mode, the control circuit 100 controls the transfer gate 234 to turn into the OFF state (S173). Thus, the voltage supplied to the electrode 611 is held to be a voltage just before a transition to the transfer mode, that is, a voltage which has sufficiently approached the voltage of the criterion voltage signal VBS.

In a case where a predetermined time elapses after the transfer gate 234 is controlled to be in the OFF state, the control circuit 100 controls release of charges by the second discharge unit (S174). That is, a mode in which the second discharge unit performs an operation is performed. Specifically, the control circuit 100 supplies the drive data signal DRV for generating the discharge control signal DIS2 having an H level, to the drive signal generation circuit 50.

Since charges accumulated in the node a are released by the second discharge unit after the transfer gate 234 is controlled to be in the OFF state, the voltage at the node a is lowered. Thus, the leakage current generated in the transfer gate 234 is reduced, and a rising of the voltage of the electrode 611 by the leakage current is prevented. The charges may be continuously released by the second discharge unit until the mode transitions to the printing mode or the standby mode.

In a case where a predetermined time elapses after the release of the charges by the second discharge unit starts, the control circuit 100 controls the release of the charges by the third discharge unit (S175). That is, a mode in which the third discharge unit performs an operation is performed. Specifically, the control circuit 100 supplies the drive data signal DRV for generating the discharge control signal DIS3 having an H level, to the drive signal generation circuit 50. Since the charges accumulated in the node c are released by the third discharge unit before the charges accumulated in the node b by the first discharge unit, it is possible to reduce an occurrence of a situation in which the voltage supplied to the electrode 612 is higher than the voltage supplied to the electrode 611. That is, it is possible to reduce an occurrence of a situation in which the piezoelectric element 60 performs displacement in a direction opposite to the displacement of the piezoelectric element 60 during a printing operation. Thus, it is possible to reduce stress occurring in the piezoelectric element 60 and the vibration plate 621.

Release of the charges by the second discharge unit and release of the charges by the third discharge unit may be simultaneously performed by the control circuit 100, for example. The charges may be released by the third discharge unit, and then the charges may be released by the second discharge unit. The charges may be continuously released by the third discharge unit until the mode transitions to the printing mode or the standby mode.

In a case where a predetermined time elapses after the release of the charges by the second discharge unit and the third discharge unit starts, the control circuit 100 controls the release of the charges by the first discharge unit (S176). That is, a mode in which the first discharge unit performs an operation is performed. Specifically, the control circuit 100 supplies the drive data signal DRV for generating the discharge control signal DIS1 having an H level, to the drive signal generation circuit 50. Thus, the charges accumulated in the electrode 611 are released. Accordingly, a probability that the piezoelectric element 60 has a not-intended voltage is reduced. The occurrence of a situation in which the piezoelectric element 60 and the vibration plate 621 perform not-intended displacement is reduced. The charges may be continuously released by the first discharge unit until the mode transitions to the printing mode or the standby mode.

In a case where a predetermined time elapses after the release of the charges by the first discharge unit, the second discharge unit, and the third discharge unit described above starts, the control circuit 100 causes the operation mode to transition to the sleep mode, as illustrated in FIG. 3. The charges may be continuously released by the first discharge unit, the second discharge unit, and the third discharge unit in the sleep mode.

7. Advantageous Effects

In the above-described liquid ejecting apparatus 1 in the embodiment, it is possible to release the charges in the electrode 611 of the piezoelectric element 60 via the parasitic diodes 241 and 242 formed in the transfer gate 234, by the first discharge unit. Thus, the occurrence of a situation in which the electrode 611 of the piezoelectric element 60 has a not-intended voltage is reduced. Accordingly, an occurrence of applying a not-intended voltage to the piezoelectric element 60 is reduced, and the occurrence of a situation in which the piezoelectric element 60 performs not-intended displacement is reduced.

In the liquid ejecting apparatus 1 in the embodiment, it is possible to release the charges at the node a by the second discharge unit. Thus, it is possible to reduce the voltage at the node a and to reduce the leakage current generated via the resistance component of the transfer gate 234. Accordingly, it is possible to further reduce the occurrence of applying the not-intended voltage caused by the leakage current to the piezoelectric element 60. Thus, it is possible to further reduce the occurrence of a situation in which the piezoelectric element 60 performs not-intended displacement.

In the liquid ejecting apparatus 1 in the embodiment, it is possible to release the charges at the node c by the third discharge unit. Thus, it is possible to reduce an occurrence of applying a not-intended voltage to the electrode 612 of the piezoelectric element. Accordingly, it is possible to further reduce the occurrence of a situation in which the piezoelectric element 60 performs not-intended displacement.

The invention includes substantially the same configuration as the configuration described in the embodiment (for example, a configuration having the same function, method, and result, or a configuration having the same object and effect). The invention includes a configuration in which non-essential parts of the configuration described in the embodiment are replaced. The invention includes a configuration that can achieve a configuration for obtaining the same advantageous effect or the same object as the configuration described in the embodiment. The invention includes a configuration in which a well-known technique is added to the configuration described in the embodiment.

What is claimed is:

1. A liquid ejecting apparatus comprising:

a piezoelectric element that includes a first electrode to which a drive signal is supplied and a second electrode to which a criterion voltage signal is supplied, and that performs displacement by a potential difference between the first electrode and the second electrode;

a cavity which is filled with a liquid being ejected from a nozzle by the displacement of the piezoelectric element;

a vibration plate which is provided between the cavity and the piezoelectric element; and a first switching circuit that includes a first terminal to which the drive signal is supplied and a second terminal which is electrically connected to the first electrode, and that controls a supply of the drive signal to the first electrode, wherein a first mode in which charges at a first node at which the first electrode and the second terminal are electrically connected to each other are released via a parasitic diode of the first switching circuit is provided.

2. The liquid ejecting apparatus according to claim 1, wherein the first switching circuit includes an NMOS transistor and a PMOS transistor, the first terminal is electrically connected to a drain terminal of the NMOS transistor and a source terminal of the PMOS transistor, the second terminal is electrically connected to a source terminal of the NMOS transistor and a drain terminal of the PMOS transistor, and in the first mode, a back gate terminal of the NMOS transistor and a back gate terminal of the PMOS transistor are electrically connected to a ground terminal.

3. The liquid ejecting apparatus according to claim 1, wherein, in a case where the first switching circuit is in an OFF state, the first mode is performed.

4. The liquid ejecting apparatus according to claim 1, further comprising:

a criterion-voltage signal generation circuit that outputs the criterion voltage signal from a third terminal; and a second switching circuit which is provided to be capable of switching an electrical connection between the third terminal and a ground terminal, wherein a second mode in which charges at a second node at which the second electrode and the third terminal are electrically connected to each other are released via the second switching circuit is provided.

5. The liquid ejecting apparatus according to claim 4, wherein the first mode is performed after the second mode.

6. The liquid ejecting apparatus according to claim 4, wherein the second mode is performed in a case where the first switching circuit is in an OFF state.

7. The liquid ejecting apparatus according to claim 1, further comprising:

a drive circuit that outputs the drive signal from a fourth terminal; and a third switching circuit which is provided to be capable of switching an electrical connection between the fourth terminal and a ground terminal, wherein a third mode in which charges at a third node at which the first terminal and the fourth terminal are connected to each other are released via the third switching circuit is provided.

8. The liquid ejecting apparatus according to claim 7, wherein the first mode is performed after the third mode.

9. The liquid ejecting apparatus according to claim 7, wherein the third mode is performed in a case where the first switching circuit is in an OFF state.

10. A liquid ejecting apparatus comprising:

a piezoelectric element that includes a first electrode to which a drive signal is supplied and a second electrode to which a criterion voltage signal is supplied, and that performs displacement by a potential difference between the first electrode and the second electrode;

a cavity which is filled with a liquid being ejected from a nozzle by the displacement of the piezoelectric element;

a vibration plate which is provided between the cavity and the piezoelectric element; and a first switching circuit that includes a first terminal to which the drive signal is supplied and a second terminal which is electrically connected to the first electrode, and that controls a supply of the drive signal to the first electrode, wherein the first switching circuit includes a PMOS transistor, the first terminal is electrically connected to a source terminal of the PMOS transistor, the second terminal is electrically connected to a drain terminal of the PMOS transistor, a back gate terminal of the PMOS transistor is electrically connected to one end of a switch element, and another end of the switch element is electrically connected to a ground terminal.

11. The liquid ejecting apparatus according to claim 10, wherein the source terminal is electrically connected to a first P-type semiconductor layer provided in an N-type semiconductor layer, the drain terminal is electrically connected to a second P-type semiconductor layer provided in the N-type semiconductor layer so as to be spaced from the first P-type semiconductor layer, and the back gate terminal is electrically connected to the N-type semiconductor layer.

12. The liquid ejecting apparatus according to claim 10, wherein the switch element is provided in a fourth switching circuit, and the fourth switching circuit controls whether to supply a voltage to the back gate terminal or whether to electrically connect the back gate terminal and the ground terminal to each other.

* * * * *